US008429931B2

(12) United States Patent
Ikegami et al.

(10) Patent No.: US 8,429,931 B2
(45) Date of Patent: Apr. 30, 2013

(54) EJECTOR REFRIGERANT CYCLE DEVICE

(75) Inventors: Makoto Ikegami, Anjo (JP); Hirotsugu Takeuchi, Nagoya (JP); Etsuhisa Yamada, Kariya (JP); Haruyuki Nishijima, Obu (JP); Hideya Matsui, Kariya (JP)

(73) Assignee: Denso Corporation, Kariya (JP)

( * ) Notice: Subject to any disclaimer, the term of this patent is extended or adjusted under 35 U.S.C. 154(b) by 309 days.

(21) Appl. No.: 12/658,485

(22) Filed: Feb. 9, 2010

(65) Prior Publication Data

US 2010/0139315 A1 Jun. 10, 2010

Related U.S. Application Data

(62) Division of application No. 11/653,474, filed on Jan. 12, 2007, now Pat. No. 7,690,218.

(30) Foreign Application Priority Data

Jan. 13, 2006 (JP) ..... 2006-5847
Aug. 7, 2006 (JP) ..... 2006-214404

(51) Int. Cl.
*F25B 1/06* (2006.01)

(52) U.S. Cl.
USPC ..... 62/500; 62/513; 62/525; 62/526

(58) Field of Classification Search ..... 62/500, 62/513, 525, 526
See application file for complete search history.

(56) References Cited

U.S. PATENT DOCUMENTS 4,741,178 A * 5/1988 Fujiu et al. ..... 62/525
5,385,035 A * 1/1995 Nishida et al. ..... 62/525
6,477,857 B2 11/2002 Takeuchi et al.

(Continued)

FOREIGN PATENT DOCUMENTS

EP 0 487 002 11/1991
JP 51-126550 11/1976

(Continued)

OTHER PUBLICATIONS

2002 Ashrae Handbook Refrigeration SI Edition, American Society of Heating, Refrigerating and Air-Conditioning Engineers, Inc. pp. 45.22-45.31.

(Continued)

*Primary Examiner* — Cheryl J Tyler
*Assistant Examiner* — Melanie Phero
(74) *Attorney, Agent, or Firm* — Harness, Dickey & Pierce, PLC

(57) ABSTRACT

An ejector refrigerant cycle device includes a radiator for radiating heat of high-temperature and high-pressure refrigerant discharged from a compressor, a branch portion for branching a flow of refrigerant on a downstream side of the radiator into a first stream and a second stream, an ejector that includes a nozzle portion for decompressing and expending refrigerant of the first stream from the branch portion, a decompression portion for decompressing and expanding refrigerant of the second stream from the branch portion, and an evaporator for evaporating refrigerant on a downstream side of the decompression portion. The evaporator has a refrigerant outlet coupled to the refrigerant suction port of the ejector. Furthermore, a refrigerant radiating portion is provided for radiating heat of refrigerant while the decompression portion decompresses and expands refrigerant. For example, the refrigerant radiating portion is provided in an inner heat exchanger.

10 Claims, 12 Drawing Sheets

U.S. PATENT DOCUMENTS

| | | | | |
|---|---|---|---|---|
| 6,574,987 | B2 | 6/2003 | Takeuchi et al. | |
| 6,698,221 | B1 * | 3/2004 | You | 62/196.4 |
| 6,729,149 | B2 | 5/2004 | Takeuchi | |
| 6,918,266 | B2 * | 7/2005 | Ikegami et al. | 62/500 |
| 2004/0206111 | A1 | 10/2004 | Ikegami et al. | |
| 2005/0178150 | A1 | 8/2005 | Oshitani et al. | |
| 2005/0268644 | A1 | 12/2005 | Oshitani et al. | |
| 2006/0107673 | A1 * | 5/2006 | Hirota | 62/222 |
| 2006/0156745 | A1 * | 7/2006 | Ikegami et al. | 62/170 |
| 2006/0218964 | A1 * | 10/2006 | Saito et al. | 62/500 |
| 2007/0000262 | A1 * | 1/2007 | Ikegami et al. | 62/170 |
| 2007/0039349 | A1 * | 2/2007 | Yamada et al. | 62/500 |
| 2007/0137230 | A1 * | 6/2007 | Bae et al. | 62/198 |
| 2007/0163293 | A1 * | 7/2007 | Ikegami et al. | 62/500 |

FOREIGN PATENT DOCUMENTS

| | | |
|---|---|---|
| JP | 54-162260 | 12/1979 |
| JP | 03-005674 | 1/1991 |
| JP | 03-291465 | 12/1991 |
| JP | 2006-029714 | 2/2006 |
| WO | WO 2006/109617 | 10/2006 |

OTHER PUBLICATIONS

C. Yang; P.K. Bansal, Numerical Investigation of Capillary Tube-Suction Line Heat Exchanger Performance; Applied Thermal Engineering 25 (2005) 2014-2028, Dept. of Mechanical Engineering, The University of Auckland, New Zealand; Jun. 19, 2004.

Office action dated Oct. 19, 2010 in corresponding Japanese Application No. 2006-214404.

* cited by examiner

EJECTOR REFRIGERANT CYCLE DEVICE

CROSS REFERENCE TO RELATED APPLICATION

This application is a divisional of U.S. patent application Ser. No. 11/653,474 filed on Jan. 12, 2007. This application claims the benefit and priority of Japanese Patent Applications No. 2006-005847 filed on Jan. 13, 2006 and No. 2006-214404 filed on Aug. 7, 2006. The entire disclosures of each of the above applications are incorporated herein by reference.

FIELD OF THE PRESENT INVENTION

The present invention relates to an ejector refrigerant cycle device having an ejector.

BACKGROUND OF THE PRESENT INVENTION

JP-A-2005-308380 (corresponding to US 2005/0268644 A1) discloses an ejector refrigerant cycle device. In this ejector refrigerant cycle device, a refrigerant flow is branched at a branch portion on the downstream side of a radiator and on the upstream side of a nozzle portion of an ejector into two streams, one of which flows to the nozzle portion, and the other of which flows to a refrigerant suction port of the ejector.

In the ejector refrigerant cycle device of this document, a first evaporator is disposed on the downstream side of a diffuser portion of the ejector. Between the branch portion and the refrigerant suction port of the ejector, there are provided with a throttle mechanism serving as decompression means for decompressing the refrigerant and a second evaporator for evaporating the decompressed refrigerant to allow the evaporated refrigerant to be drawn into the refrigerant suction port of the ejector.

A pressure increasing effect of the diffuser portion of the ejector increases a refrigerant evaporation pressure (i.e., refrigerant evaporation temperature) of the first evaporator more than that of the second evaporator, so that the refrigerant can evaporate in different temperature ranges at the first and second evaporators. Furthermore, the downstream side of the first evaporator is connected to a compressor suction side, and the pressure of refrigerant to be drawn by the compressor is increased, thereby decreasing a compressor driving force and improving a cycle efficiency (i.e., performance of cycle COP).

In order to further improve the cycle efficiency, the inventors of the present application try an ejector refrigerant cycle which includes an inner heat exchanger for exchanging heat between high-temperature and high-pressure refrigerant on the downstream side of the radiator and low-temperature and low-pressure refrigerant on the suction side of the compressor in addition to the structure of the ejector refrigerant cycle device disclosed in the JP-A-2005-308380. In this case, the enthalpy of the refrigerant flowing into each of the first and second evaporators is decreased by the heat exchange of the refrigerants in the inner heat exchanger, whereby a difference in enthalpy of the refrigerant (refrigeration capacity) between the refrigerant inlet and outlet in each of the first and second evaporators is increased, thus improving the cycle efficiency as compared with the cycle disclosed in the JP-A-2005-308380.

However, when the ejector refrigerant cycle device provided with the inner heat exchanger is actually activated, the throttle mechanism on the upstream side of the second evaporator does not decompress the refrigerant sufficiently. Thus, the ejector refrigerant cycle device often operates while the refrigerant evaporation pressure of the second evaporator does not decrease enough with respect to the refrigerant evaporation pressure of the first evaporator. If the refrigerant cycle is operated in such a state, the second evaporator cannot provide a sufficient refrigeration capacity.

SUMMARY OF THE PRESENT INVENTION

The inventors of the present application have found that this problem is due to the fact that the refrigerant brought into a super-cooled state after radiating heat in the inner heat exchanger flows into the throttle mechanism. This is because, when the refrigerant flowing into the throttle mechanism is in the super-cooled state (liquid-phase state), the density of the refrigerant is increased, resulting in an increase in mass flow amount of the refrigerant passing through the throttle mechanism. In other words, the increase in mass flow amount of the refrigerant passing through the throttle mechanism leads to a decrease in resistance of a passage of the throttle mechanism through which the refrigerant passes, resulting in a decrease in amount of pressure reduction of the refrigerant by the throttle mechanism.

Furthermore, in order to appropriately decompress the refrigerant by the decompression means, the inventors have calculated a relationship between the shape of the throttle mechanism serving as the decompression means and the flow amount of the refrigerant passing through the throttle mechanism based on a report and experimental formulas described by ASHRAE Research, "2002 ASHRAE HANDBOOK REFRIGERATION SI Edition," USA, American Society of Heating, Refrigerating and Air-Conditioning Engineers, Inc. edition, June 2002, p 45.23 to p 45.30.

FIG. 24 is a graph showing a result of the computation of the above-mentioned relationship. In this computation, a capillary tube is used as the throttle mechanism. In FIG. 24, a lateral axis is an index I/d representing the shape of the capillary tube (a ratio of the length I of the capillary tube to the inner diameter d of the capillary tube), and a longitudinal axis indicates the flow amount (mass flow amount) of the refrigerant when a refrigerant pressure at an inlet of the capillary tube is set to a predetermined value.

Furthermore, FIG. 24 also represents by plots the computational results of two cases: where the refrigerant flowing to the capillary tube is in the super-cooled state, and where the refrigerant is in a vapor-liquid two-phase state. Here, the dryness of the refrigerant of the vapor-liquid two-phase state is set as 0.03 to 0.25 in the computation. This dryness corresponds to a dryness of refrigerant on the downstream side of a radiator in a normal ejector refrigerant cycle device.

Referring to FIG. 24, when the refrigerant flowing into the capillary tube becomes the super-cooled state, the flow amount of the refrigerant is increased as compared with a case of the refrigerant in the vapor-liquid two-phase state, and an increase in value of I/d does not lead to a decrease of the refrigerant flow amount below a predetermined value. That is, modification to the shape of the capillary tube cannot increase an amount of pressure reduction more than a predetermined value.

Therefore, FIG. 24 has shown that the use of the refrigerant in the vapor-liquid two-phase state flowing into the capillary tube can increase effectively the reduced amount of pressure of the refrigerant in the capillary tube as compared with the case of the refrigerant in the super-cooled state. However, the flowing of the refrigerant in the vapor-liquid two-phase state into the throttle mechanism tends to lead to an increase in enthalpy of the refrigerant flowing into the evaporator as compared with the case of flowing the refrigerant in the super-cooled state into the throttle mechanism. Accordingly, the cycle efficiency is likely to be reduced when the refrigerant in the vapor-liquid two-phase state flows into the throttle mechanism.

In view of the above-mentioned problems, an object of the present invention is to appropriately decompress refrigerant by a decompression means disposed on an upstream side of an evaporator that is coupled to a refrigerant suction port of an ejector, without causing a decrease in cycle efficiency.

It is another object of the present invention to provide an ejector refrigerant cycle device with a new cycle structure, which can effectively increase its cycle efficiency.

According to a first aspect of the present invention, an ejector refrigerant cycle device includes a compressor for compressing and discharging refrigerant, a radiator for radiating heat of high-temperature and high-pressure refrigerant discharged from the compressor, a branch portion for branching a flow of refrigerant on a downstream side of the radiator into a first stream and a second stream, and an ejector that has a nozzle portion for decompressing and expending refrigerant of the first stream from the branch portion, and a refrigerant suction port from which refrigerant is drawn by a high-velocity flow of refrigerant jetted from the nozzle portion. Furthermore, the ejector refrigerant cycle device includes: decompression means for decompressing and expanding refrigerant of the second stream from the branch portion; an evaporator for evaporating refrigerant on a downstream side of the decompression means and having a refrigerant outlet coupled to the refrigerant suction port of the ejector; and refrigerant radiating means for radiating heat of refrigerant while the decompression means decompresses and expands refrigerant.

Accordingly, even when the refrigerant at an outlet of the radiator is in the vapor-liquid two-phase state, the cycle efficiency of the ejector refrigerant cycle device can be effectively increased.

Generally, in the ejector refrigerant cycle device, when the refrigerant at the outlet of the radiator is in the vapor-liquid two-phase state, the refrigerant in the vapor-liquid two-phase state on the downstream side of the radiator may flow into the decompression means. This can increase greatly the reduced amount of pressure of the refrigerant as compared with a case of flowing the refrigerant in the super-cooled state into the decompression means from the radiator. However, in the ejector refrigerant cycle device, the refrigerant radiating means radiates heat of the refrigerant while the decompression means decompresses refrigerant, it can decrease the pressure of the refrigerant as well as the enthalpy thereof at the same time as indicated by the line from the D point to the J point of a Mollier diagram of FIG. 2, for example.

As a result, this can increase the difference in enthalpy of the refrigerant between the refrigerant inlet and outlet of the evaporator (refrigeration capacity), thereby decompressing the refrigerant appropriately without causing a decrease in cycle efficiency.

Accordingly, even if the dryness of the vapor-liquid two-phase refrigerant is extremely small (for example, the dryness is 0.03), the reduced amount of pressure of the refrigerant flowing into the decompression means can be increased sufficiently by the decompression means.

For example, the refrigerant radiating means is an inner heat exchanger that exchanges heat between refrigerant passing through the decompression means and refrigerant to be drawn to the compressor.

Furthermore, a vapor/liquid separating unit for separating refrigerant on a downstream side of the radiator into vapor-phase refrigerant and liquid-phase refrigerant may be provided. In this case, the branch portion branches the liquid-phase refrigerant separated by the vapor/liquid separating unit into the first stream and the second stream.

Alternatively, the decompression means may be used as a first decompression portion, and a second decompression portion for decompressing refrigerant of the second stream from the branch portion may be further provided. In this case, the second decompression portion is located at a position downstream of the branch portion and upstream of the first decompression portion, and decompresses refrigerant of the second stream branched from the branch portion in a vapor-liquid two-phase state at an upstream side of the first decompression portion in a refrigerant flow of the second stream.

Alternatively, the second decompression portion may be located at a position upstream of the branch portion and downstream of the radiator in a refrigerant flow, and decompresses the refrigerant in a vapor-liquid two-phase state. In this case, the second decompression portion may be a variable throttle mechanism which reduces its throttle passage area as a super-cooling degree of refrigerant at a downstream side of the radiator increases.

Alternatively, a second decompression portion may be provided for decompressing refrigerant after being decompressed by the first decompression portion. In this case, the second decompression portion is located at a position downstream of the first decompression portion and upstream of the evaporator, and the first decompression portion decompresses refrigerant of the second stream branched from the branch portion in a vapor-liquid two-phase state at the upstream side of the second decompression portion in a refrigerant flow of the second stream.

According to another aspect of the present invention, an ejector refrigerant cycle device includes: a compressor for compressing and discharging refrigerant; a radiator for radiating heat of high-temperature and high-pressure refrigerant discharged from the compressor; a branch portion for branching a flow of refrigerant on a downstream side of the radiator into a first stream and a second stream; an ejector that includes a nozzle portion for decompressing and expending refrigerant of the first stream from the branch portion, and a refrigerant suction port from which refrigerant is drawn by a high-velocity flow of refrigerant jetted from the nozzle portion; a first decompression means for decompressing and expanding refrigerant of the second stream branched from the branch portion; an evaporator for evaporating refrigerant on a downstream side of the first decompression means and having a refrigerant outlet coupled to the refrigerant suction port of the ejector; and a second decompression means, located downstream of the branch portion and upstream of the first decompression means in a refrigerant flow of the second stream, for decompressing refrigerant of the second stream in a vapor-liquid two-phase state. Even in this case, the cycle efficiency of the ejector refrigerant cycle device can be effectively increased by using the first decompression means and the second decompression means.

BRIEF DESCRIPTION OF THE DRAWINGS

Additional objects and advantages of the present invention will be more readily apparent from the following detailed description of preferred embodiments when taken together with the accompanying drawings. In the drawings.

DETAILED DESCRIPTION OF THE PREFERRED EMBODIMENTS

First Embodiment

Figure 1:
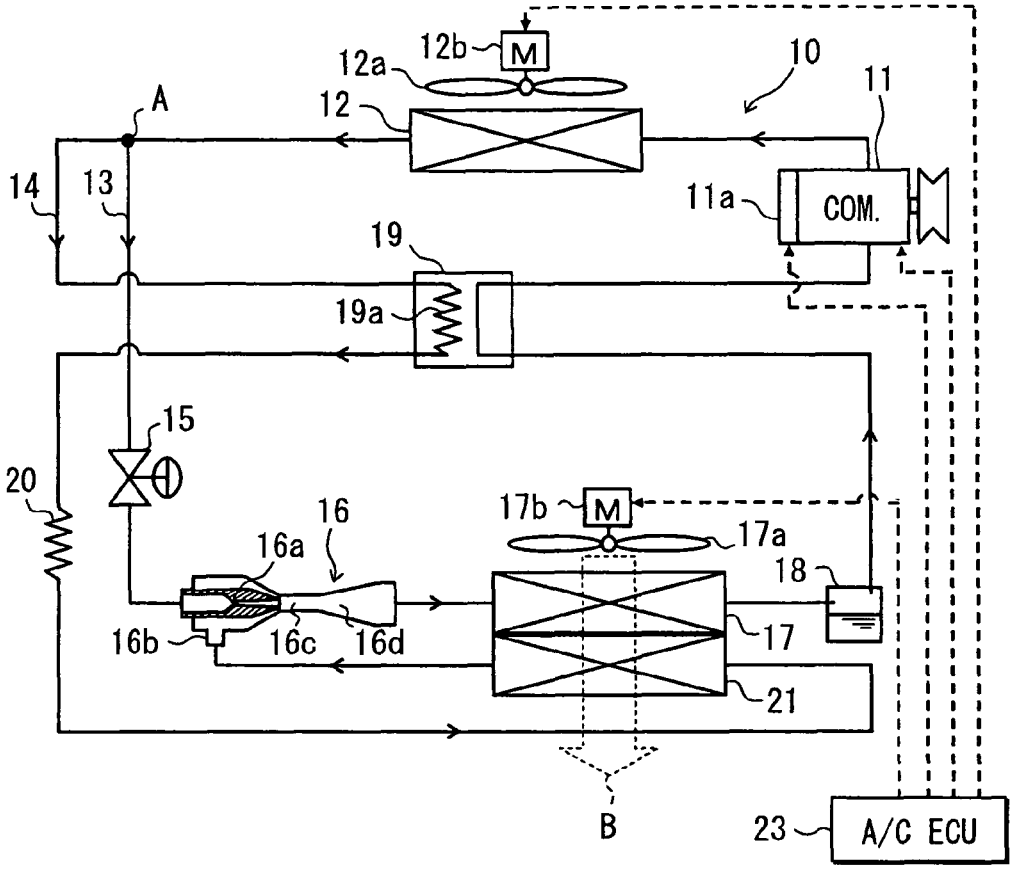
FIG. 1 is a schematic diagram showing an ejector refrigerant cycle device according to a first embodiment of the present invention.
Figure 2:
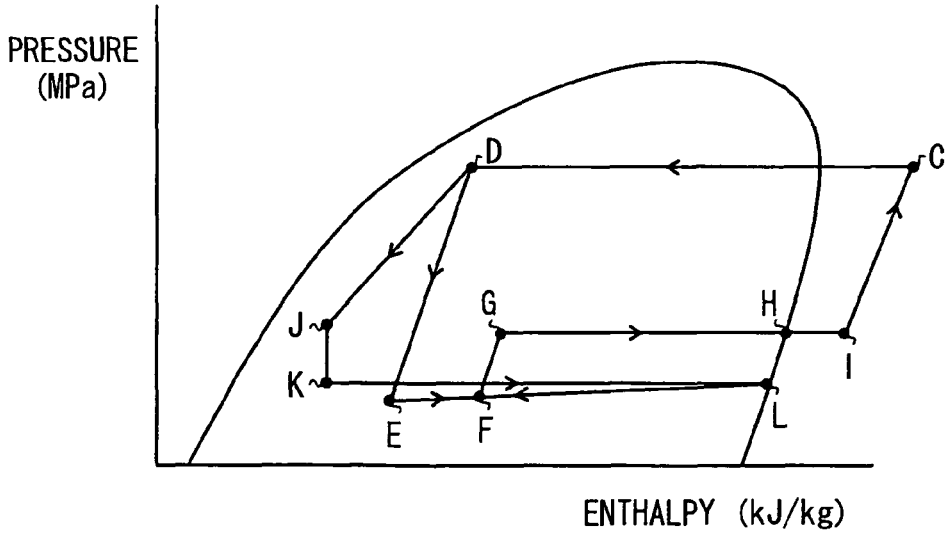
FIG. 2 is a Mollier diagram showing operation of the ejector refrigerant cycle device according to the first embodiment.

Referring to FIGS. 1 and 2, a first embodiment of the present invention will be described below. FIG. 1 shows an entire configuration diagram of an example in which an ejector refrigerant cycle device of the first embodiment is applied to a refrigeration device for a vehicle. The refrigeration device for a vehicle of the embodiment is to cool a refrigeration compartment to a very low temperature, for example, about −20° C.

First, in an ejector refrigerant cycle device 10, a compressor 11 draws, compresses and discharges refrigerant, and has a driving force transmitted thereto from a vehicle running engine (not shown) via a pulley and a belt, thereby being rotatably driven. Moreover, in this embodiment, a well-known swash plate type variable displacement compressor capable of controlling a discharge volume variably and continuously by a control signal from the outside is used as the compressor 11.

The discharge volume means a geometrical volume of an operating space in which refrigerant is drawn and compressed and, specifically, means a cylinder volume between the top dead center and the bottom dead center of the stroke of a piston of the compressor 11. By changing the discharge volume, the discharge capacity of the compressor 11 can be adjusted. The changing of the discharge volume is performed by controlling the pressure Pc of a swash plate chamber (not shown) constructed in the compressor 11 to change a slant angle of a swash plate thereby to change the stroke of the piston.

The pressure Pc of the swash plate chamber is controlled by changing the ratio of a discharge refrigerant pressure Pd to a suction refrigerant pressure Ps, which are introduced into the swash plate chamber, using an electromagnetic volume control valve 11*a* driven by the output signal of an air-conditioning control unit 23 to be described later. With this, the compressor 11 can change the discharge volume continuously within a range of from about 0% to 100%.

Moreover, since the compressor 11 can change the discharge volume continuously within the range of about 0% to 100%, the compressor 11 can be brought substantially into an operation stop state by decreasing the discharge volume to nearly 0%. Thus, this embodiment adopts a clutch-less construction in which the rotary shaft of the compressor 11 is always coupled to the vehicle running engine via the pulley and the belt.

Of course, even a variable displacement compressor may be constructed to have power transmitted from the vehicle running engine via an electromagnetic clutch. Moreover, when a fixed displacement compressor is used as the compressor 11, it is also recommend that an on-off control for operating the compressor intermittently by an electromagnetic clutch is performed to control an operating ratio, that is, a ratio of the on operation to the off operation of the compressor, thereby controlling the discharge capacity of the refrigerant of the compressor. Alternatively, an electric compressor rotatably driven by an electric motor may be used. In this case, the number of revolutions of the electric motor is controlled by control of the frequency of an inverter or the like, thereby controlling the discharge capacity of the refrigerant of the compressor.

A radiator 12 is connected to the downstream side of the refrigerant flow of the compressor 11. The radiator 12 is a heat exchanger that exchanges heat between high-pressure refrigerant discharged from the compressor 11 and the outside air (i.e., air outside a vehicle compartment) blown by a blower fan 12*a* to cool the high-pressure refrigerant so as to radiate the heat thereof. The blower fan 12*a* is an electrically operated fan driven by a motor 12*b*. Furthermore, the motor 12*b* is rotatably driven by a control voltage outputted from the air-conditioning control unit 23 (A/C ECU) to be described later.

The ejector refrigerant cycle device of the embodiment is constructed with a subcritical cycle in which the pressure of the high-pressure refrigerant is not increased above a supercritical pressure of refrigerant, and the radiator 12 serves as a condenser for cooling and condensing the refrigerant. The refrigerant cooled by the radiator 12 reaches the vapor-liquid two-phase state in the normal operation. For example, when the outdoor temperature in winter is low, the refrigerant often becomes the super-cooled state.

A branch portion A for branching a refrigerant flow from the radiator 12 is disposed on the downstream side of the radiator 12. One refrigerant stream branched at the branch portion A is introduced into a nozzle-portion side piping 13 which connects the branch portion A with the upstream side of a nozzle portion 16*a* of the ejector 16 to be described later. The other refrigerant stream branched at the branch portion A is introduced into a suction-port side piping 14 which connects the branch portion A with a refrigerant suction port 16*b* of the ejector 16.

In the nozzle-portion side piping 13 into which the refrigerant branched by the branch portion A flows, a variable throttle mechanism 15 is disposed. The variable throttle mechanism 15 serves to determine a flow amount ratio $\eta$ ($\eta$=Ge/Gnoz) of a refrigerant flow amount Ge flowing to the suction-port side piping 14 to a refrigerant flow amount Gnoz flowing from the branch portion A to the nozzle-portion side piping 13.

More specifically, in the embodiment, a well-known thermal expansion valve is adopted as the variable throttle mechanism 15, and adjusts the flow amount of the refrigerant passing through the variable throttle mechanism 15 by changing the degree of an opening of a valve body (not shown) in accordance with the degree of superheat of the refrigerant on the outlet side of a second evaporator 21 to be described later. The flow amount ratio $\eta$ is set to an appropriate value such that the superheat degree of the refrigerant on the outlet side of the second evaporator 21 approaches a predetermined value. Note that description of components of the thermal expansion valve, such as a temperature sensitive cylinder or an equalizing pipe, will be omitted for convenience in terms of illustration.

As the variable throttle mechanism 15, an electric throttle mechanism may be adopted. The temperature and pressure of the refrigerant on the outlet side of the second evaporator 21 may be detected, and the superheat degree of the refrigerant on the outlet side of the second evaporator 21 may be calculated based on these detected values. In this case, the flow amount of the refrigerant can be adjusted such that the superheat degree is the predetermined value. Additionally, or alternatively, the temperature and pressure of the refrigerant flowing from the radiator 12 may be detected. In this case, the flow amount of the refrigerant can be adjusted such that the temperature and pressure of the refrigerant flowing from the radiator 12 are predetermined values based on these detected values.

The ejector 16 includes a nozzle portion 16*a* that reduces the pressure of the refrigerant flowing therein to expand the refrigerant in an isentropic manner, and a refrigerant suction port 16*b* that is provided so as to communicate with a refrigerant ejection port of the nozzle portion 16*a*. The ejector 16 draws the vapor-phase refrigerant from the second evaporator 21 through the refrigerant suction port 16*b* to be described later.

Furthermore, the ejector 16 includes a mixing portion 16*c* that is arranged on the downstream side of the nozzle portion 16*a* and the refrigerant suction port 16*b* and mixes a high-velocity refrigerant jetted from the nozzle portion 16*a* with suction refrigerant drawn from the refrigerant suction port 16*b*, and a diffuser portion 16*d* that is arranged on the downstream side of the mixing portion 16*c* and serves as a pressure increasing portion adapted for reducing the velocity of the refrigerant flow so as to increase the refrigerant pressure.

The diffuser portion 16*d* is formed in such a shape to gradually increase the passage area of the refrigerant and has an action of reducing the velocity of the refrigerant flow to increase the refrigerant pressure, that is, a function of converting the velocity energy of the refrigerant to the pressure energy thereof. A first evaporator 17 is connected to the downstream side of the refrigerant flow of the diffuser portion 16*d* of the ejector 16.

The first evaporator 17 is a heat exchanger that exchanges heat between low-pressure refrigerant having its pressure reduced by the nozzle portion 16*a* of the ejector 16 and air in a refrigeration compartment blown by the blower fan 17*a* so as to absorb the heat from air by the low-pressure refrigerant. Therefore, the air in the refrigeration compartment is cooled while passing through the first evaporator 17. The blower fan 17*a* is an electrically operated fan driven by a motor 17*b*. The motor 17*b* is rotatably driven based on a control voltage outputted from the air-conditioning control unit 23 to be described later.

An accumulator 18 is connected to the downstream side of the refrigerant flow of the first evaporator 17. The accumulator 18 is formed in the shape of a tank, and is a vapor/liquid separating unit for separating the refrigerant in a vapor and liquid mixed state on the downstream side of the first evaporator 17, into vapor-phase refrigerant and liquid-phase refrigerant by using a difference in density. Thus, the vapor-phase refrigerant is collected on the upper side of the inner space shaped like a tank of the accumulator 18 in the vertical direction, whereas the liquid-phase refrigerant is collected on the lower side in the vertical direction thereof.

Furthermore, a vapor-phase refrigerant outlet is provided at the top of the tank-shaped accumulator 18. The vapor-phase refrigerant outlet is connected to an inner heat exchanger 19, which has a refrigerant outlet side connected to the suction side of the compressor 11.

Next, the inner heat exchanger 19, a second fixed throttle 20, and a second evaporator 21 are disposed in the suction-port side piping 14 into which the other refrigerant branched by the branch portion A flows.

The inner heat exchanger 19 exchanges heat between the refrigerant on the downstream side of the branch portion A and the refrigerant on the suction side of the compressor 11 to radiate the heat of the refrigerant passing through the suction-port side piping 14. Therefore, the refrigerant flowing into the suction-port side piping 14 is cooled in the inner heat exchanger 19, thereby increasing a difference in enthalpy of the refrigerant between the refrigerant inlet and outlet at the second evaporator 21 to be described later to enhance the refrigeration capacity of the refrigerant cycle.

Furthermore, a refrigerant passage of the inner heat exchanger 19 provided in the suction-port side piping 14, through which the refrigerant on the downstream side of the branch portion A passes, includes a first fixed throttle 19*a* serving as a throttle mechanism for decompressing and expanding the refrigerant on the downstream side of the branch portion A. Therefore, in the embodiment, the first fixed throttle 19*a* is decompression means for decompressing and expanding the refrigerant on the downstream side of the branch portion A, and the inner heat exchanger 19 is also refrigerant radiating means.

More specifically, the first fixed throttle 19*a* of the inner heat exchanger 19 is constituted of a capillary tube. The inner heat exchanger 19 is formed in such a manner that the first fixed throttle 19*a* and a refrigerant pipe on the suction side of the compressor 11 are brazed to each other. It is apparent that any other connecting means, such as weld, pressure welding, or soldering, may be used to form the inner heat exchanger. Accordingly, in the embodiment, the first fixed throttle 19*a* serving as the decompression means and the inner heat exchanger serving as the refrigerant radiating means are constructed integrally, which exhibits an effect of reducing the size of the cycle.

The capillary tube used as the first fixed throttle 19*a* in the inner heat exchanger 19 is to decompress the refrigerant by the action of restriction of the refrigerant passage area as well as by friction within the refrigerant passage, and hence has an elongated shape with a predetermined refrigerant passage length. Thus, the use of the capillary tube as the first fixed throttle 19*a* makes it easy to ensure an area of heat exchange when the refrigerant pipe on the suction side of the compressor 11 is brazed. As a result, the refrigerant passing through the first fixed throttle 19*a* tends to have its heat radiated.

The inner heat exchanger 19 may be constituted of double piping, in which an inner piping may be used as the capillary tube, and the space between the inner piping and an outer piping may be used as the refrigerant piping on the suction side of the compressor 11.

The second fixed throttle 20 is decompression means for further decompressing and expanding the refrigerant which has been decompressed and expanded by the first fixed throttle 19*a*. More specifically, although in the embodiment, the second fixed throttle 20 is constituted of a capillary tube, it may be constituted of an orifice. Note that in the embodiment the second fixed throttle 20 may be used as auxiliary decompressing means for the first fixed throttle 19*a*, but may be omitted.

The second evaporator 21 is a heat exchanger for evaporating the refrigerant to exert a heat absorbing action. In the embodiment, the first evaporator 17 and the second evaporator 21 are assembled to an integrated structure. More specifically, the components of the first evaporator 17 and those of the second evaporator 21 are made of aluminum and brazed to the integrated structure.

Thus, the air blown by the above-mentioned blower fan 17*a* flows in the direction of the arrow B, and is first cooled by the first evaporator 17 and then cooled by the second evaporator 21. In other words, the first evaporator 17 and the second evaporator 21 cool a single space (the same space) to be cooled.

The air-conditioning control unit 23 is constructed of a well-known microcomputer including a CPU, a ROM, a RAM and the like and its peripheral circuit. The air-conditioning control unit 23 performs various kinds of computations and processing on the basis of control programs stored in the ROM to control the operations of the above-mentioned various kinds of devices 11*a*, 12*b*, 17*b*, etc.

Moreover, into the air-conditioning control unit 23, detection signals from a group of various kinds of sensors and various operating signals from an operating panel (not shown) are input. Specifically, as the group of sensors, an outside air sensor for detecting the temperature of the outside air (i.e., the temperature of the air outside the vehicle compartment) or the like is provided. Furthermore, the operating panel is provided with an operating switch for operating the refrigeration device, a temperature setting switch for setting a cooling temperature of the space to be cooled, and the like.

Next, an operation of the ejector refrigerant cycle device of the first embodiment with the above-mentioned arrangement will be described below. The operation state of the refrigerant in this refrigerant cycle is shown in a Mollier diagram of FIG. 2.

First, when the vehicle running engine is operated, a rotational drive force is transmitted from the vehicle running engine to the compressor 11. Further, when the operating signal of the operating switch is inputted to the air-conditioning control unit 23 from the operating panel, an output signal is outputted from the air-conditioning control unit 23 to the electromagnetic volume control valve 11*a* based on the control program previously stored.

The discharge volume of the compressor 11 is determined by this output signal. The compressor 11 draws vapor-phase refrigerant flowing from the accumulator 18 via the inner heat exchanger 19, and compresses and discharges the vapor-phase refrigerant. The compressed state of the refrigerant at this time corresponds to the point C of FIG. 2. The high-temperature and high-pressure vapor-phase refrigerant discharged from the compressor 11 flows into the radiator 12 to be cooled by the outside air, so that the refrigerant is brought into the vapor-liquid two-phase state (corresponding to the point D). The refrigerant corresponding to the point D of FIG. 2 is in the vapor-liquid two-phase state with the dryness that permits the second evaporator 21 to have a suitable refrigeration capacity.

Furthermore, the refrigerant in the vapor-liquid two-phase state flowing out of the radiator 12 is divided by the branch portion A into two flows, one of which flows into the nozzle-portion side piping 13, and the other of which flows into the suction-port side piping 14*a*. The flow amount Gnoz of the refrigerant flowing from the branch portion A into the nozzle-portion side piping 13 and the flow amount Ge of the refrigerant flowing into the suction-port side piping 14 are adjusted by the variable throttle mechanism 15 such that the flow amount ratio $\eta$ approaches to an appropriate value as mentioned above.

Then, the refrigerant having branched from the branch portion A into the nozzle portion size piping 13 flows into the nozzle portion 16*a* of the ejector 16. The refrigerant flowing into the nozzle portion 16*a* is decompressed and expanded by the nozzle portion 16*a* (from the point D to the point E of FIG. 2). At this decompression and expansion time, the pressure energy of the refrigerant is converted to the velocity energy, so that the refrigerant is ejected from a refrigerant ejection port of the nozzle portion 16*a* at high velocity.

The refrigerant suction action of the high-velocity refrigerant flow from the ejection port of the nozzle portion 16*a* draws the refrigerant having passed through the second evaporator 21 through the refrigerant suction port 16*b*. The refrigerant ejected from the nozzle portion 16*a* and the refrigerant drawn from the refrigerant suction port 16*b* are mixed by the mixing portion 16*c* on the downstream side of the nozzle portion 16*a* to flow into the diffuser portion 16*d*. In this diffuser portion 16*d*, the velocity energy of the refrigerant is converted to the pressure energy by enlarging the passage area, so that the pressure of the refrigerant is increased (from the point E to the point F, and then to the point G of FIG. 2).

The refrigerant flowing from the diffuser portion 16*d* of the ejector 16 flows into the first evaporator 17, in which the low-pressure refrigerant absorbs heat from the blown air of the blower fan 17*a* to evaporate (from the point G to the point H of FIG. 2). The refrigerant having passed through the first evaporator 17 flows into the accumulator 18 to be divided into vapor-phase refrigerant and liquid-phase refrigerant.

The low-pressure vapor-phase refrigerant flowing from the accumulator 18 flows into the inner heat exchanger 19 and exchanges heat with the high-pressure refrigerant flowing from the branch portion A to the suction-port side piping 14 (from the point H to the point I of FIG. 2). The vapor-phase refrigerant flowing from the inner heat exchanger 19 is drawn into and compressed again by the compressor 11.

The vapor-liquid two-phase refrigerant flowing from the branch portion A to the suction-port side piping 14 flows into the first fixed throttle 19*a* of the inner heat exchanger 19. The refrigerant flowing to the first fixed throttle 19*a* of the inner heat exchanger 19 is decompressed and expanded when passing through the first fixed throttle 19*a* of the inner heat exchanger 19, while exchanging heat with the refrigerant on the suction side of the compressor 11 thereby to radiate the heat (from the point D to the point J of FIG. 2). Because the vapor-liquid two-phase refrigerant from the radiator 12 flows to the first fixed throttle 19*a*, the refrigerant can be decompressed appropriately by the first fixed throttle 19*a*.

The refrigerant flowing out of the first fixed throttle 19*a* of the inner heat exchanger 19 is decompressed when passing through the second fixed throttle 20, and then flows into the second evaporator 21 (from the point J to the point K of FIG. 2). In the second evaporator 21, the low-pressure refrigerant flowing further absorbs heat from the blown air of the blower fan 17*a*, which is cooled by the first evaporator 17, to evaporate (from the point K to the point L of FIG. 2).

And, the refrigerant evaporating at the second evaporator 21 is drawn into the refrigerant suction port 16*b* of the ejector 16 via the suction-port side piping 14, and mixed with the liquid-phase refrigerant having passed through the nozzle portion 16*a* by the mixing portion 16*c* (from the point L to the point F of FIG. 2) to flow out to the first evaporator 17.

As mentioned above, in this embodiment, the refrigerant in the vapor-liquid two-phase state on the downstream side of the radiator 12 flows into the first fixed throttle 19*a* arranged in the refrigerant passage of the inner heat exchanger 19, so that the refrigerant can be decompressed appropriately by the first fixed throttle 19*a*. As a result, the refrigerant evaporation temperatures of the first evaporator 17 and of the second evaporator 21 can be set in different temperature ranges, while permitting the second evaporator 21 to exert the sufficient refrigeration capacity.

Furthermore, in the first fixed throttle 19*a*, the refrigerant on the downstream side of the branch portion A is decompressed and expanded, while radiating the heat of the refrigerant at the same time. Thus, as illustrated by a line from the point D to the point J of the Mollier diagram of FIG. 2, the pressure and enthalpy of the refrigerant can be simultaneously decreased, so that the difference in enthalpy of the refrigerant (refrigeration capacity) between the refrigerant inlet and outlet of the second evaporator 21 can be increased. As a result, the cycle efficiency of the ejector refrigerant cycle can be improved.

According to the first embodiment, the inner heat exchanger 19 includes a first refrigerant passage portion provided with the first fixed throttle 19*a*, and a second refrigerant passage portion through which refrigerant downstream from the outlet side of the ejector 16 flows toward the refrigerant suction side of the compressor 11. Furthermore, the first refrigerant passage portion having the first fixed throttle 19*a* and the second refrigerant passage portion can be suitably constructed in the inner heat exchanger 19 only when refrigerant from the branch portion A is cooled in the first refrigerant passage portion while the refrigerant is decompressed by the first fixed throttle 19*a*. Furthermore, in this embodiment, because the first evaporator 17 and the accumulator 18 are provided downstream from the refrigerant outlet of the ejector 16, the separated vapor refrigerant in the accumulator 18 is introduced to the second refrigerant passage portion of the inner heat exchanger 19. However, in the refrigerant cycle of the ejector refrigerant cycle device of the first embodiment, one of the first evaporator 17 and the accumulator 18 may be omitted, or both of the first evaporator 17 and the accumulator 18 may be omitted.

Second Embodiment

Figure 3:
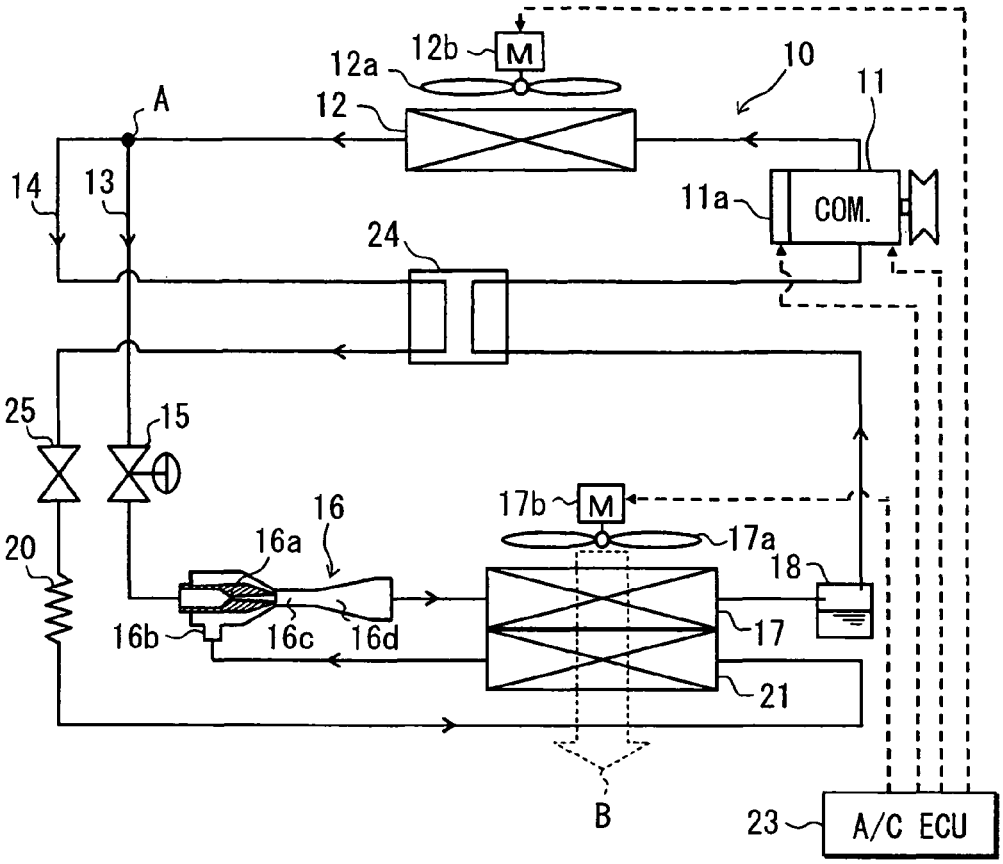
FIG. 3 is a schematic diagram showing an ejector refrigerant cycle device according to a second embodiment of the present invention.

The above-described first embodiment has explained the adoption of the inner heat exchanger 19 as one example in which the refrigerant passage in the suction-port side piping 14 is constructed of the first fixed throttle 19*a*. That is, the refrigerant flowing into the inner heat exchanger 19 from the branch portion A is throttled while being cooled. However, in the second embodiment, an inner heat exchanger 24 without having a throttle function is adopted as shown in FIG. 3. The inner heat exchanger 24, whose refrigerant passage is not constructed of the throttle mechanism, has only a function of exchanging heat between the refrigerant on the downstream side of the branch portion A and the refrigerant on the suction side of the compressor 11.

A first fixed throttle 25 serving as the decompression means for decompressing and expanding the refrigerant to bring it into the vapor-liquid two-phase state is disposed on the downstream side of the inner heat exchanger 24 in the suction-port side piping 14 and on the upstream side of the second fixed throttle 20. More specifically, the first fixed throttle 25 is constituted of an orifice, as an example.

Therefore, in this embodiment, the first fixed throttle 25 serves as the decompression means disposed on the upstream side of the second fixed throttle 20, so as to bring the refrigerant on the downstream side of the branch portion A into the vapor-liquid two-phase state. Then, the second fixed throttle 20 further decompresses the refrigerant flowing out of the first fixed throttle 25.

Although in this embodiment the first fixed throttle 25 is constructed of the orifice, it may be constructed of a capillary tube as a matter of course. Other components of this embodiment may have the same structures as those of the first embodiment.

Figure 4:
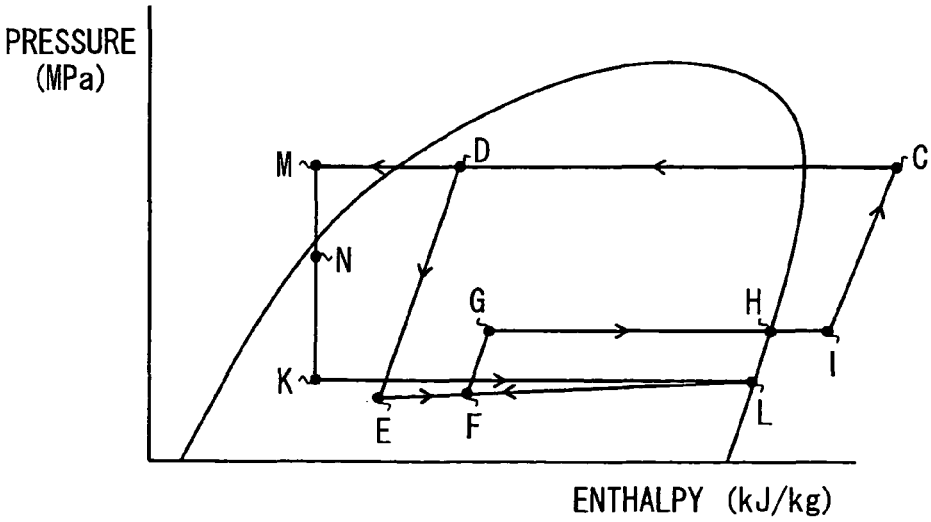
FIG. 4 is a Mollier diagram showing operation of the ejector refrigerant cycle device according to the second embodiment.

Next, an operation of this embodiment will be described below. The state of the refrigerant in this cycle is shown in a Mollier diagram of FIG. 4. In FIG. 4, the same reference numerals are used to represent the same state of the refrigerant as that shown in FIG. 2.

First, similarly to the first embodiment, the compressor 11 is operated to compress the refrigerant, which is then cooled by the radiator 12 (from the point C to the point D of FIG. 4). In the embodiment, the refrigerant cooled by the radiator 12 becomes the vapor-liquid two-phase state as indicated by the point D in FIG. 4.

Furthermore, similarly to the first embodiment, the refrigerant in the vapor-liquid two-phase state flowing from the radiator 2 is divided by the branch portion A into two flows, one of which flows into the nozzle-portion side piping 13 and then to the nozzle portion 16*a*, the mixing portion 16*c*, the diffuser portion 16*d* of the ejector 16, the first evaporator 17, and the accumulator 18 in that order (i.e., in this order of the point D, the point E, the point F, the point G, and the point H of FIG. 4).

The low-pressure vapor-phase refrigerant flowing from the accumulator 18 flows into the inner heat exchanger 24 and exchanges heat with the high-pressure refrigerant flowing from the branch portion A to the suction-port side piping 14 (from the point H to the point I of FIG. 4). The vapor-phase refrigerant flowing out of the inner heat exchanger 24 is drawn into and compressed again by the compressor 11. On the other hand, the refrigerant flowing from the branch portion A to the suction-port side piping 14 flows into the inner heat exchanger 24, and exchanges heat with the refrigerant on the suction side of the compressor 11 to radiate the heat to reach the super-cooled state (from the point D to the point M of FIG. 4). The refrigerant flowing from the inner heat exchanger 24 in the super-cooled state is decompressed by the first fixed throttle 25 to become the vapor-liquid two-phase state (from the point M to the point N of FIG. 4).

The refrigerant in the vapor-liquid two-phase state flows into the second fixed throttle 20, where it is further decompressed and expanded (from the point N to the point K of FIG. 4). The second fixed throttle 20 decompresses the refrigerant in the vapor-liquid two-phase state on the downstream side of the first fixed throttle 25, and thus can decompress the refrigerant appropriately.

Similarly to the first embodiment, the refrigerant flowing out of the second fixed throttle 20 flows into the second evaporator 21 and absorbs heat from the blown air of the blower fan 17*a*, which has been cooled by the first evaporator 17. Therefore, refrigerant is evaporated in the second evaporator 21, and is drawn into the refrigerant suction port 16*b* of the ejector 16, so that the refrigerant is mixed with the liquid-phase refrigerant having passed through the nozzle portion 16*a* by the mixing portion 16*c*. In this refrigerant flow, the refrigerant operation state is changed in this order of the point K, the point L and the point F in FIG. 4.

As mentioned above, in the embodiment, the refrigerant in the vapor-liquid two-phase state on the downstream side of the first fixed throttle 25 flows into the second fixed throttle 20, whereby the refrigerant can be decompressed appropriately by the fixed throttle 20. As a result, the refrigerant evaporation temperatures of the first evaporator 17 and the second evaporator 21 can surely be positioned in the different temperature ranges, and the second evaporator 21 can exert the sufficient refrigeration capacity.

Furthermore, as indicated by the operation line from the point D to the point M of FIG. 4, because the enthalpy of the refrigerant can be decreased at the inner heat exchanger 24, it is possible to sufficiently increase the enthalpy difference of the refrigerant between the refrigerant inlet and outlet of the second evaporator 21. This result can improve the cycle efficiency.

Moreover, the refrigerant in the super-cooled state is changed into the vapor-liquid two-phase state at the first fixed throttle 25. Accordingly, even if the refrigerant at the outlet of the radiator 12 is in the super-cooled state, the above-mentioned effect can be obtained. In the cycle of the embodiment, the inner heat exchanger 24 may be omitted, and the refrigerant flowing from the branch portion A to the suction-port side piping 14 may directly flow into the first fixed throttle 25.

Third Embodiment

Figure 5:
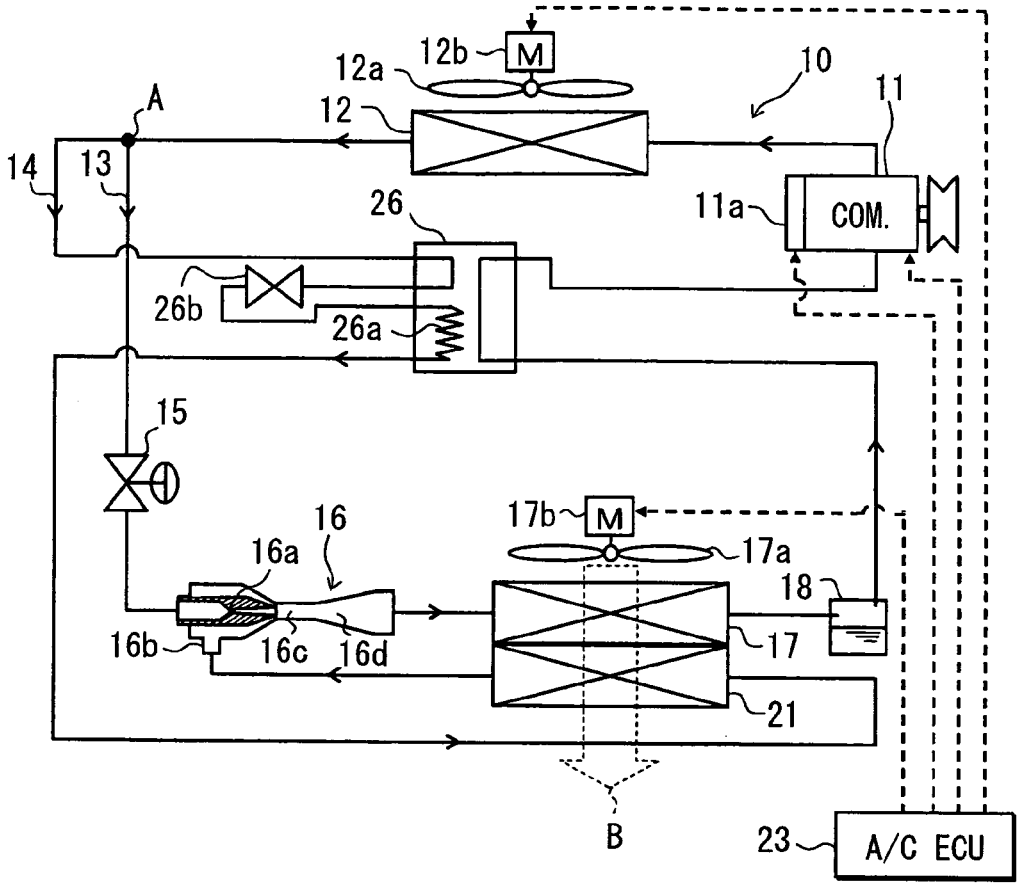
FIG. 5 is a schematic diagram showing an ejector refrigerant cycle device according to a third embodiment of the present invention.

The above-described first embodiment has explained the adoption of the inner heat exchanger 19 as one example in which the refrigerant passage on the downstream side of the branch portion A is constructed of the first fixed throttle 19*a*. However, in the third embodiment, instead of the inner heat exchanger 19 and the second fixed throttle 20 described in the first embodiment, an inner heat exchanger 26 is used as shown in FIG. 5.

In one refrigerant passage of the inner heat exchanger 26, through which the refrigerant on the downstream side of the branch portion A passes, there are provided with a first fixed throttle 26*a* constituted of a capillary tube, and a second fixed throttle 26*b* arranged on the upstream side of the first fixed throttle 26*a*. For example, the second fixed throttle 26*b* is constituted of an orifice or a throttle passage.

Like the first fixed throttle 19*a* of the inner heat exchanger 19 in the first embodiment, the first fixed throttle 26*a* is brazed to a refrigerant piping on the suction side of the compressor 11, and is configured to decompress and expand the refrigerant on the downstream side of the branch portion A, while radiating heat at the same time.

The second fixed throttle 26*b* is located upstream from the first fixed throttle 26*a* in a refrigerant flow from the branch portion A. In this embodiment, the second fixed throttle 26*b* is not brazed to the refrigerant piping on the suction side of the compressor 11, but is separated from the refrigerant piping on the suction side of the compressor 11. Therefore, the second fixed throttle 26*b* has only a function of decompressing and expanding the refrigerant on the downstream side of the branch portion A to bring the refrigerant into a vapor-liquid two-phase state. The second fixed throttle 26*b* may be formed integrally with or separately from the inner heat exchanger 26.

Therefore, in this third embodiment, the first fixed throttle 26*a* serves as the decompression means for decompressing and expanding the vapor-liquid two-phase refrigerant after being decompressed in the second fixed throttle 26*b*. The second fixed throttle 26*b* serves as the decompression means disposed on the upstream side of the first fixed throttle 26*a* and adapted for decompressing and expanding the refrigerant on the downstream side of the branch portion A to bring it into the vapor-liquid two-phase state. Other components of this embodiment may have the same structures as those of the first embodiment.

Figure 6:
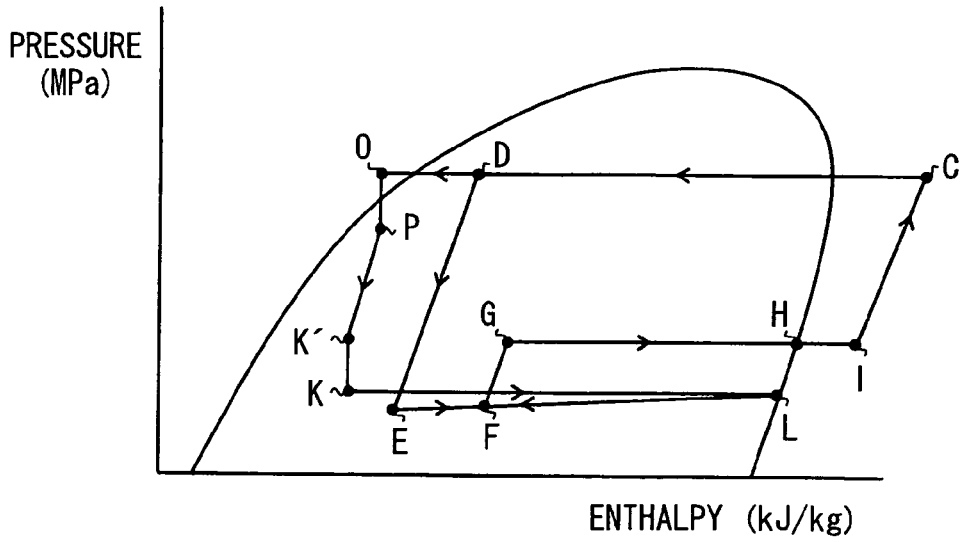
FIG. 6 is a Mollier diagram showing operation of the ejector refrigerant cycle device according to the third embodiment.

Next, an operation of this embodiment will be described below. The operation state of the refrigerant in this refrigerant cycle is shown in a Mollier diagram of FIG. 6. In FIG. 6, the same reference numerals are used to represent the same operation state of the refrigerant as that shown in FIG. 2.

First, similarly to the first embodiment, when the refrigerant cycle of the third embodiment is operated, the refrigerant discharged from the compressor 11 is cooled by the radiator 12. Furthermore, the refrigerant in the vapor-liquid two-phase state flowing from the radiator 12 is divided by the branch portion A into two flows, one of which flows into the nozzle-portion side piping 13, and then to the nozzle portion 16*a*, the mixing portion 16*c*, the diffuser portion 16*d* of the ejector 16, the first evaporator 17, and the accumulator 18 in that order (i.e., in this order of the point C, the point D, the point E, the point F, the point G, and the point H of FIG. 6).

The low-pressure vapor-phase refrigerant flowing out of the accumulator 18 flows into the inner heat exchanger 26 and exchanges heat with the high-pressure refrigerant flowing from the branch portion A into the suction-port side piping 14 (from the point H to the point I of FIG. 6). The vapor-phase refrigerant flowing out of the inner heat exchanger 26 is drawn into and compressed again by the compressor 11. On the other hand, the refrigerant flowing from the branch portion A into the suction-port side piping 14 flows into the inner heat exchanger 26 and exchanges heat with the refrigerant on the suction side of the compressor 11 to radiate the heat to be brought into the super-cooled state (from the point D to the point O of FIG. 6). Furthermore, the refrigerant in the super-cooled state is decompressed by the second fixed throttle 26*b* to reach the vapor-liquid two-phase refrigerant state (from the point O to the point P of FIG. 6).

The refrigerant in the vapor-liquid two-phase state flows into the first fixed throttle 26*a* to be decompressed and expanded, while exchanging heat with the refrigerant on the suction side of the compressor 11 to radiate the heat (from the point P to the point K' and the point K of FIG. 6 in that order). Here, since the refrigerant in the vapor-liquid two-phase state on the downstream side of the second fixed throttle 26*b* flows into the first fixed throttle 26*a*, the refrigerant can be decompressed appropriately by the first fixed throttle 26*a* provided in the inner heat exchanger 26.

The reason why the refrigerant having passed through the first fixed throttle 26*a* expands in an isentropic manner as indicated by a line of the point K' to the point K of FIG. 6 is that when the refrigerant passing through the first fixed throttle 26*a* reaches the point K', the refrigerant is cooled to substantially a temperature corresponding to that of the refrigerant on the suction side of the compressor 11. Thus, from the operation point K' to the operation point K in FIG. 6, a transmission of heat is substantially not caused.

Furthermore, similarly to the first embodiment, the refrigerant flowing into the second evaporator 21 absorbs heat from the blown air of the blower fan 17*a*, which has been cooled by the first evaporator 17, to evaporate, and then is drawn into the refrigerant suction port 16*b* of the ejector 16 to be mixed with the liquid-phase refrigerant having passed through the nozzle portion 16*a* in the mixing portion 16*c* (in order of the point K, the point L and the point F of FIG. 6).

As mentioned above, in the third embodiment, the refrigerant in the vapor-liquid two-phase state on the downstream side of the second fixed throttle 26*b* flows into the first fixed throttle 26*a*, whereby the refrigerant can be decompressed appropriately by the first fixed throttle 26*a*. As a result, the refrigerant evaporation temperatures of the first evaporator 17 and the second evaporator 21 can surely be set in the different temperature ranges, and the second evaporator 21 can exert the sufficient refrigeration capacity.

Furthermore, as indicated by lines of the point D, the point O, the point P, and the point K of FIG. 6 in that order, the enthalpy of the refrigerant can be decreased at the inner heat exchanger 26, while the difference in enthalpy of the refrigerant between the refrigerant inlet and outlet of the second evaporator 21 (refrigeration capacity) can be increased. This result can improve the cycle efficiency.

Moreover, similarly to the second embodiment, since the refrigerant in the super-cooled state is changed into the vapor-liquid two-phase state at the second fixed throttle 26, even if the refrigerant at the outlet of the radiator 12 is in the super-cooled state, the above-mentioned effect of the first embodiment can be obtained.

Fourth Embodiment

Figure 7:
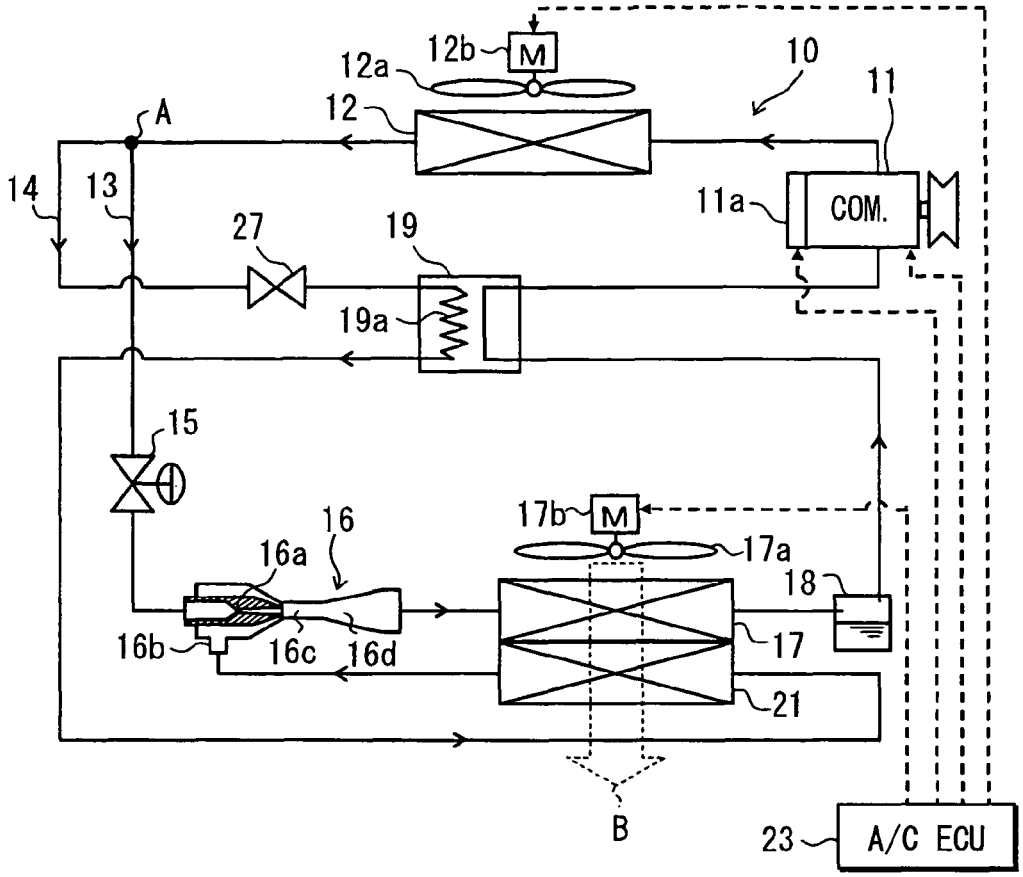
FIG. 7 is a schematic diagram showing an ejector refrigerant cycle device according to a fourth embodiment of the present invention.

In the fourth embodiment, as shown in FIG. 7, the second fixed throttle 20 of the first embodiment is not provided, and a second fixed throttle 27 is disposed on the upstream side of the inner heat exchanger 19, with respect to the cycle of the first embodiment. The second fixed throttle 27 serves as decompression means for decompressing and expanding the refrigerant from the branch portion A to bring it into the vapor-liquid two-phase state, and specifically, is constituted of an orifice or a throttled passage.

Therefore, in this embodiment, the first fixed throttle 19*a* of the inner heat exchanger 19 (capillary tube) serves as decompression means for decompressing and expanding the refrigerant branched at the branch portion A and having been decompressed by the second fixed throttle 27. The second fixed throttle 27 serves as the decompression means is disposed on the upstream side of the first fixed throttle 19*a* and is adapted for decompressing and expanding the refrigerant on the downstream side of the branch portion A to bring it into the vapor-liquid two-phase state. Other components of this embodiment may have the same structures as those of the first embodiment.

Figure 8:
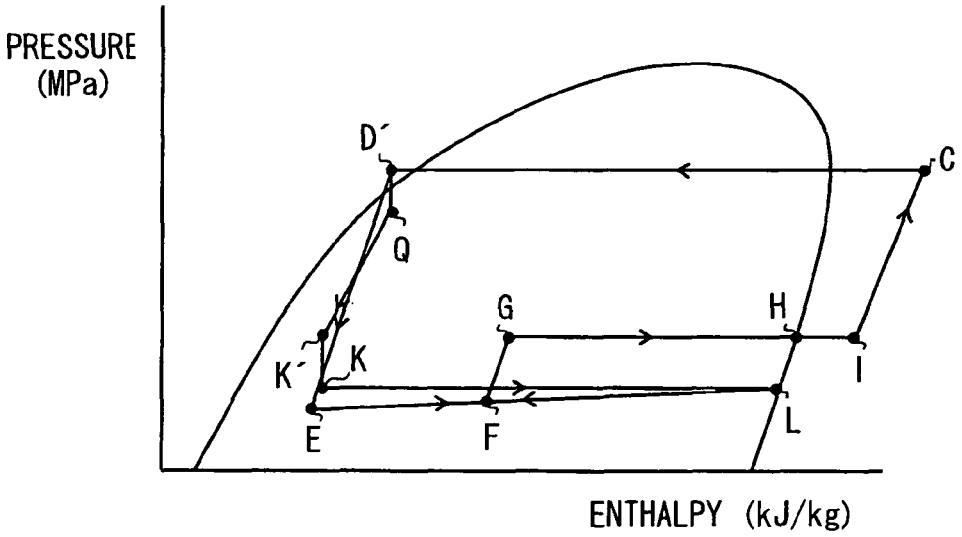
FIG. 8 is a Mollier diagram showing operation of the ejector refrigerant cycle device according to the fourth embodiment.

Next, an operation of this embodiment will be described below. The operation state of the refrigerant in this cycle is shown in a Mollier diagram of FIG. 8. In FIG. 8, the same reference numerals are used to represent the same operation state of the refrigerant as that shown in FIG. 2.

First, similarly to the first embodiment, when the compressor 11 is operated, the refrigerant is compressed and cooled by the radiator 12 (from the point C to the point D' of FIG. 8). Note that in the embodiment, as indicated by the point D' of FIG. 8, the refrigerant cooled by the radiator 12 becomes the super-cooled state. The refrigerant in the vapor-liquid two-phase state flowing from the radiator 12 is divided by the branch portion A into two flows, one of which flows into the nozzle-portion side piping 13, and then to the nozzle portion 16*a*, the mixing portion 16*c*, the diffuser portion 16*d* of the ejector 16, the first evaporator 17, and the accumulator 18 in that order (i.e., in this order of the point C, the point D', the point E, the point F, the point G, and the point H of FIG. 8).

The low-pressure vapor-phase refrigerant flowing from the accumulator 18 flows into the inner heat exchanger 26 and exchanges heat with the high-pressure refrigerant flowing from the branch portion A into the suction-port side piping 14 (from the point H to the point I of FIG. 8). The vapor-phase refrigerant flowing from the inner heat exchanger 26 is drawn into and compressed again by the compressor 11. On the other hand, the refrigerant flowing from the branch portion A into the suction-port side piping 14 flows into the second fixed throttle 27 to be decompressed to the vapor-liquid two-phase state (from the point D' to the point Q of FIG. 8). Furthermore, the refrigerant in the vapor-liquid two-phase state flows into the first fixed throttle 19*a* of the inner heat exchanger 19 to be decompressed and expanded, while simultaneously exchanging heat with the refrigerant on the suction side of the compressor 11 to radiate the heat (i.e., from the point Q to the point K' and the point K of FIG. 8 in that order).

The refrigerant in the vapor-liquid two-phase state on the downstream side of the second fixed throttle 27 flows into the first fixed throttle 19*a*, whereby the refrigerant can be decompressed appropriately by the first fixed throttle 19*a*. Also, as indicated by a line from the point K' to the point K of FIG. 8, the refrigerant having passed through the first fixed throttle 19*a* expands in an isentropic manner for the same reason as described in the third embodiment.

Furthermore, similarly to the first embodiment, the refrigerant flowing into the second evaporator 21 absorbs heat from the blown air of the blower fan 17*a*, which has been cooled by the first evaporator 17, to evaporate, and is drawn into the refrigerant suction port 16*b* of the ejector 16 to be mixed with the liquid-phase refrigerant having passed through the nozzle portion 16*a* in the mixing portion 16*c* (from the point K to the point L and the point F of FIG. 8 in that order).

As mentioned above, in the embodiment, because the refrigerant in the vapor-liquid two-phase state on the downstream side of the second fixed throttle 27 flows into the first fixed throttle 19*a*, the refrigerant can be decompressed appropriately by the first fixed throttle 19*a*. As a result, the refrigerant evaporation temperatures of the first evaporator 17 and the second evaporator 21 can surely be set in the different temperature ranges, and the second evaporator 21 can exert the sufficient refrigeration capacity.

Thus, as illustrated by a line from the point Q to the point K of FIG. 8, the enthalpy of the refrigerant can be decreased in the inner heat exchanger 19, and a difference in enthalpy of the refrigerant between the refrigerant inlet and outlet of the second evaporator 21 (refrigeration capacity) can be increased. As a result, the cycle efficiency can be improved.

In addition, in the fourth embodiment, because the refrigerant in the vapor-liquid two-phase state can flow into the first fixed throttle 19*a*, even if the refrigerant at the outlet of the radiator 12 is in the vapor-liquid two-phase state, the first fixed throttle 19*a* can decompress the refrigerant appropriately.

Fifth Embodiment

Figure 9:
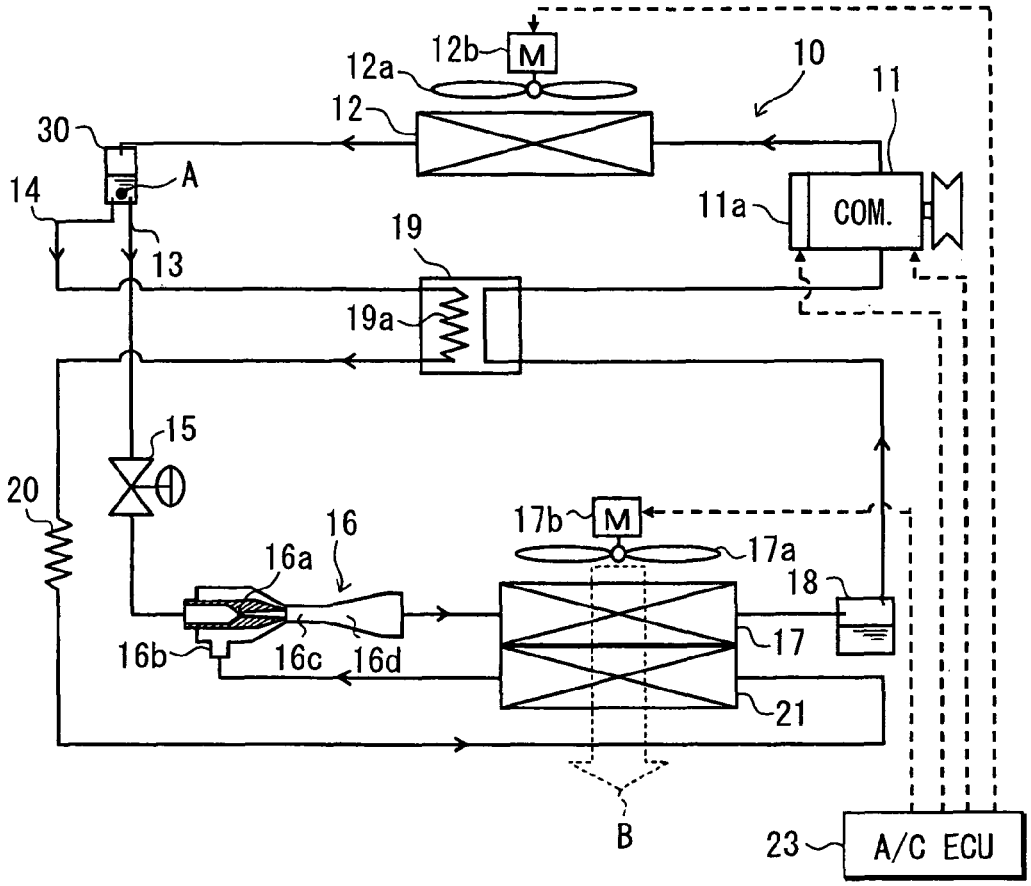
FIG. 9 is a schematic diagram showing an ejector refrigerant cycle device according to a fifth embodiment of the present invention.

In the fifth embodiment, as shown in FIG. 9, a vapor/liquid separating unit 30 for separating the refrigerant from the radiator 12 into vapor-phase refrigerant and liquid-phase refrigerant is added on the downstream side of the radiator 12*a*, in the cycle structure of the first embodiment. The vapor/liquid separating unit 30 has a tank shape, and separates the refrigerant into the vapor and liquid phases by a difference in density between the vapor-phase refrigerant and the liquid-phase refrigerant. Thus, the liquid-phase refrigerant is stored at a lower portion of the vapor/liquid separating unit 30 in the vertical direction.

Furthermore, in the embodiment, the nozzle-portion side piping 13 and the suction-port side piping 14 are connected to a liquid-phase refrigerant reservoir of the vapor/liquid separating unit 30, from which the liquid-phase refrigerant flows into the nozzle-portion side piping 13 and the section-port side piping 14 while being branched. Therefore, in the embodiment, the branch portion A is provided in the liquid-phase refrigerant reservoir of the vapor/liquid separating unit 30. Other components of this embodiment may have the same structures as those of the above-described first embodiment.

Figure 10:
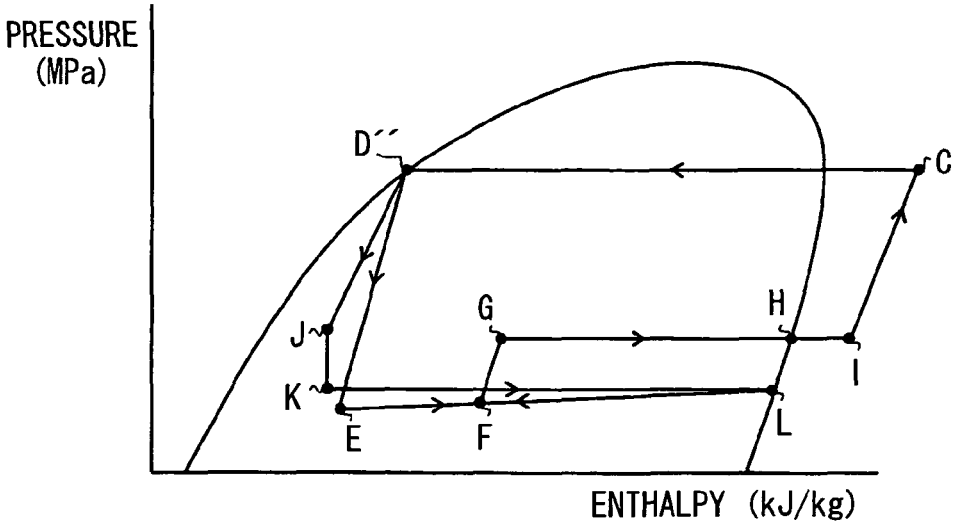
FIG. 10 is a Mollier diagram showing operation of the ejector refrigerant cycle device according to the fifth embodiment.

Next, an operation of the refrigerant cycle of this embodiment and the operation state of the refrigerant in the refrigerant cycle will be described below with reference to a Mollier diagram of FIG. 10. In FIG. 10, the same reference numerals are used to represent the same state of the refrigerant as that shown in FIG. 2.

First, when the cycle of the fifth embodiment is operated, the refrigerant discharged from the compressor 11 is cooled by the radiator 12, and is separated by the vapor/liquid separating unit 30 into the vapor-phase refrigerant and the liquid-phase refrigerant. Thus, the liquid-phase refrigerant at the vapor/liquid separating unit 30 is refrigerant on a saturated liquid line as indicated by the point D" of FIG. 10.

The liquid-phase refrigerant flowing into the nozzle-portion side piping 13 after being divided by the branch portion A flows to the nozzle portion 16*a*, the mixing portion 16*c*, the diffuser portion 16*d* of the ejector 16, the first evaporator 17, the accumulator 18, and the inner heat exchanger 19 in that order (i.e., the point C, the point D", the point E, the point F, the point G, the point H, and the point I of FIG. 10 in that order). Furthermore, the vapor-phase refrigerant flowing out of the inner heat exchanger 19 is drawn into and again compressed by the compressor 11.

On the other hand, the liquid-phase refrigerant flowing from the branch portion A to the suction-port side piping 14 flows to the first throttle means 19*a* of the inner heat exchanger 19 to be compressed and expanded, while simultaneously exchanging heat with the refrigerant on the suction side of the compressor 11 to radiate the heat (from the point D" to the point J of FIG. 10).

Since the liquid-phase refrigerant separated by the vapor/liquid separating unit 30 is the refrigerant on the saturated liquid line, the refrigerant is brought into the vapor-liquid two-phase state due to a little decrease in pressure just after the flowing into the first fixed throttle 19*a*. This substantially causes the refrigerant to flow into the first fixed throttle 19*a* in the vapor-liquid two-phase state. As a result, the first fixed throttle 19*a* can decompress the refrigerant sufficiently.

Furthermore, the refrigerant flowing out of the inner heat exchanger 19 flows to the second fixed throttle 20, the second evaporator 21, and the mixing portion 16*c* of the ejector 16 in that order, similarly to the first embodiment (i.e., from the point J to the point K, the point L, and the point F of FIG. 10 in this order).

As mentioned above, in the fifth embodiment, the first fixed throttle 19*a* can decompress the refrigerant appropriately, so that the enthalpy of the refrigerant flowing into the second evaporator 21 can be decreased, thereby obtaining the same effect as the first embodiment.

Moreover, even if the operating state of the refrigerant cycle is fluctuated due to a change in refrigeration load or the like, and the dryness of the refrigerant on the downstream side of the radiator 12 is changed, the saturated liquid refrigerant on the saturated liquid line surely flows to the first fixed throttle 19*a*. As a result, the refrigerant can be decompressed appropriately and constantly by the first fixed throttle 19*a* without being affected by the operating state of the refrigerant cycle in the ejector refrigerant cycle device.

Sixth Embodiment

Figure 11:
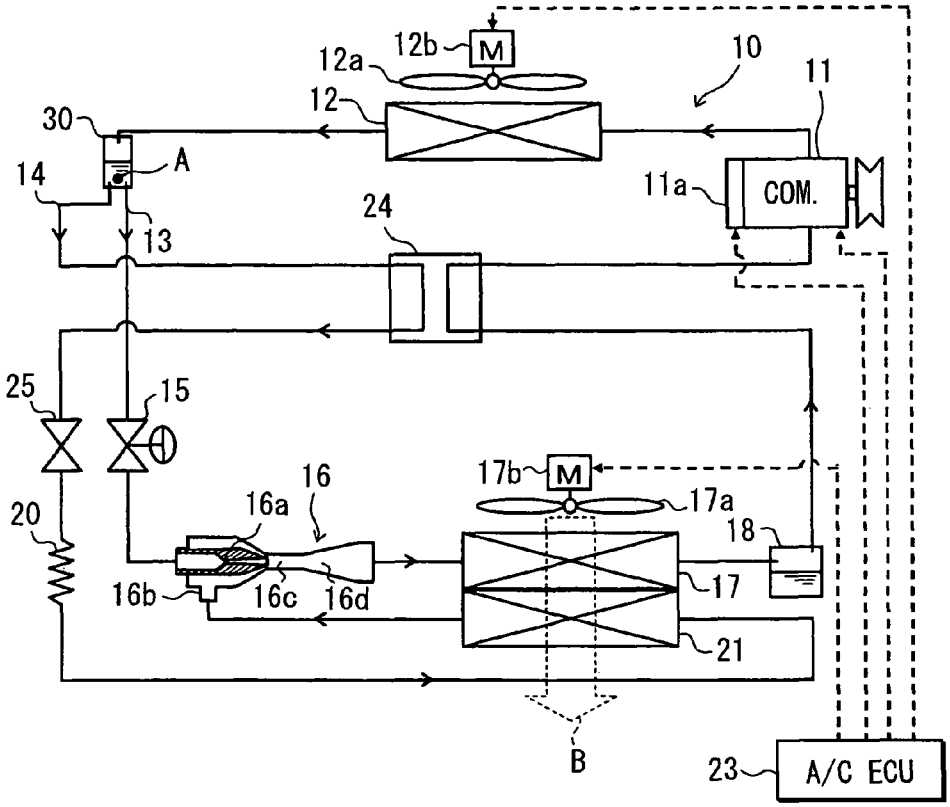
FIG. 11 is a schematic diagram showing an ejector refrigerant cycle device according to a sixth embodiment of the present invention.
Figure 12:
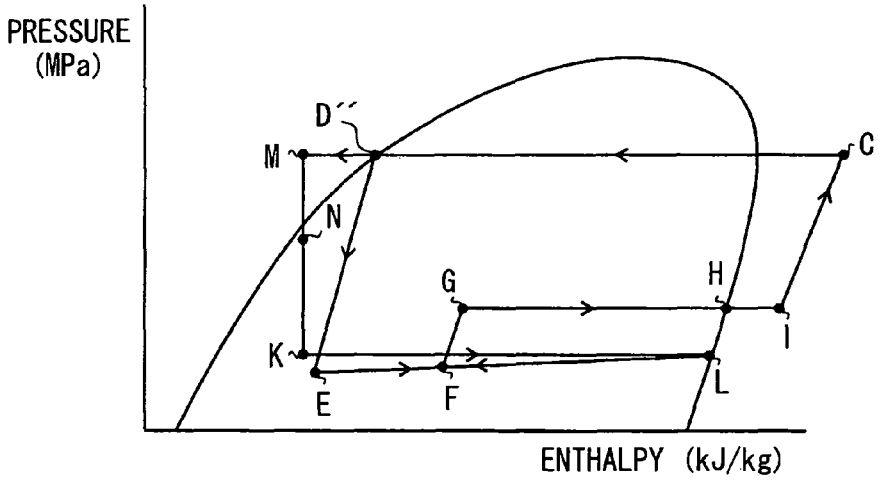
FIG. 12 is a Mollier diagram showing operation of the ejector refrigerant cycle device according to the sixth embodiment.

In the sixth embodiment, as shown in FIG. 11, the vapor/liquid separating unit 30 which has the same structure as that of the fifth embodiment is added to the refrigerant cycle of the second embodiment, and the branch portion A is provided in the liquid-phase refrigerant reservoir of the vapor/liquid separating unit 30. Other components of this embodiment have the same structures as those of the second embodiment. The state of the refrigerant in the cycle of this embodiment is shown in a Mollier diagram of FIG. 12. In FIG. 12, the same reference numerals are used to represent the same state of the refrigerant as that shown in FIG. 4.

When the refrigerant cycle of the embodiment is operated, the refrigerant at the branch portion A is saturated liquid refrigerant on a saturated liquid line (as indicated by the point D" of FIG. 12). In the second embodiment, even if the refrigerant at the outlet of the radiator 12 becomes either the supercooled state or the vapor-liquid two-phase state, the second fixed throttle 20 can decompress the refrigerant appropriately.

Thus, even when the refrigerant branched by the branch portion A is the saturated liquid refrigerant on the saturated liquid line, the second fixed throttle 20 serving as the first decompression means can decompress the refrigerant appropriately, thus obtaining the same effect as that of the second embodiment.

Furthermore, similarly to the fifth embodiment, even if the operating state of the refrigerant cycle is fluctuated due to a change in refrigeration load or the like, and the dryness of the refrigerant on the downstream side of the radiator 12 is changed, the saturated liquid refrigerant on the saturated liquid line securely flows to the first fixed throttle 25. As a result, the refrigerant can be decompressed appropriately and constantly by the second fixed throttle 20, without being affected by the operating state of the refrigerant cycle in the ejector refrigerant cycle device.

Seventh Embodiment

Figure 13:
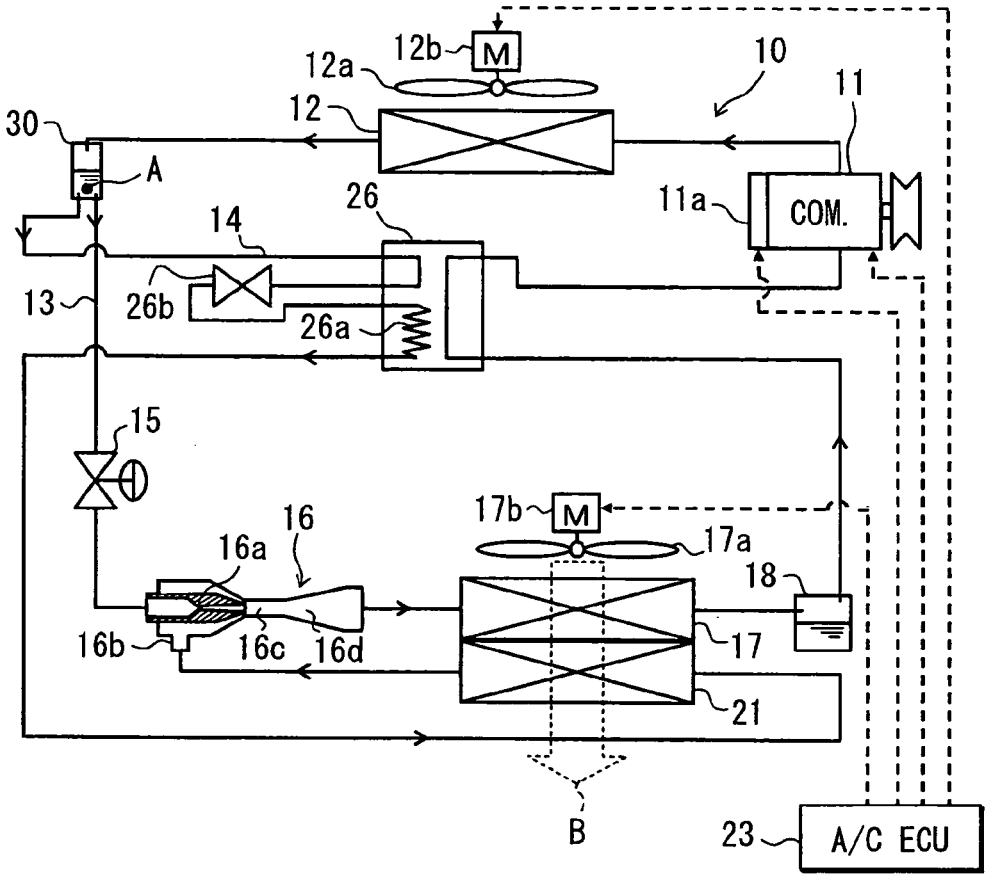
FIG. 13 is a schematic diagram showing an ejector refrigerant cycle device according to a seventh embodiment of the present invention.
Figure 14:
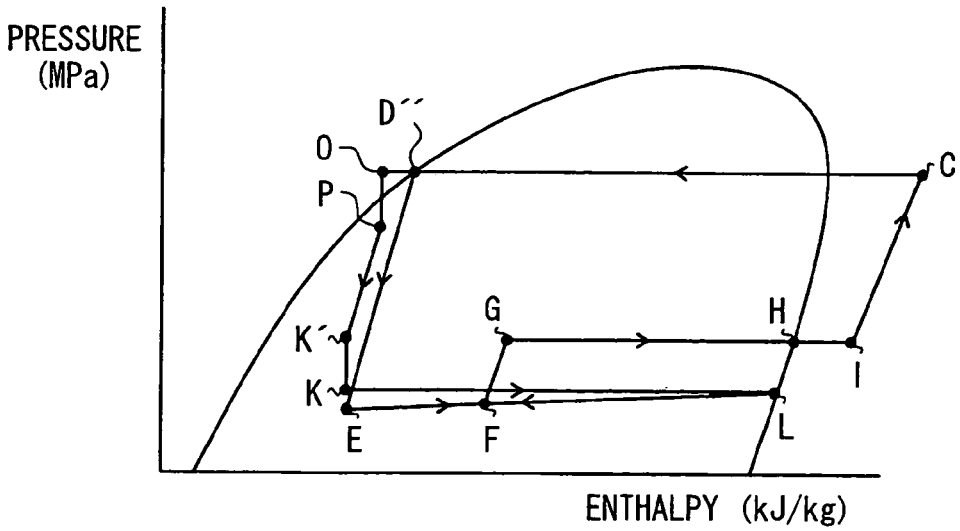
FIG. 14 is a Mollier diagram showing operation of the ejector refrigerant cycle device according to the seventh embodiment.

In this embodiment, as shown in FIG. 13, the vapor/liquid separating unit 30 which is the same structure as that of the fifth embodiment is added to the refrigerant cycle of the third embodiment, and the branch portion A is provided in the liquid-phase refrigerant reservoir of the vapor/liquid separating unit 30. Other components of this embodiment have the same structures as those of the third embodiment. The state of the refrigerant in the refrigerant cycle of this embodiment is shown in a Mollier diagram of FIG. 14. In FIG. 14, the same reference numerals are used to represent the same state of the refrigerant as that shown in FIG. 6.

When the refrigerant cycle of the embodiment is operated, the refrigerant at the branch portion A is refrigerant on a saturated liquid line (as indicated by the point D" of FIG. 14). In the third embodiment, even if the refrigerant at the outlet of the radiator 12 becomes either the super-cooled state or the vapor-liquid two-phase state, the first fixed throttle 26*a* provided in the inner heat exchanger 26 can decompress the refrigerant appropriately. Thus, even when the refrigerant branched at the branch portion A becomes the saturated liquid refrigerant on the saturated liquid line, the same effect as that of the third embodiment can be obtained.

Furthermore, similarly to the fifth embodiment, the refrigerant can be decompressed appropriately and constantly by the first fixed throttle 26*a* provided in the inner heat exchanger 26 without being affected by the operating state of the refrigerant cycle.

Eighth Embodiment

Figure 15:
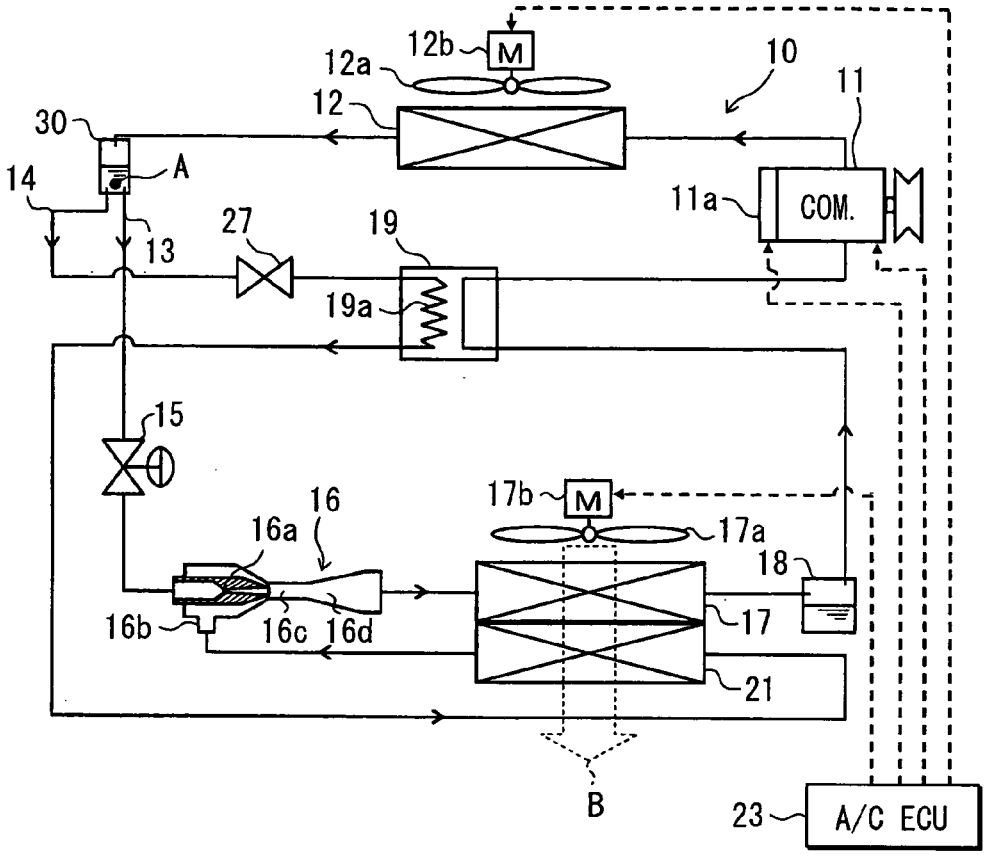
FIG. 15 is a schematic diagram showing an ejector refrigerant cycle device according to an eighth embodiment of the present invention.
Figure 16:
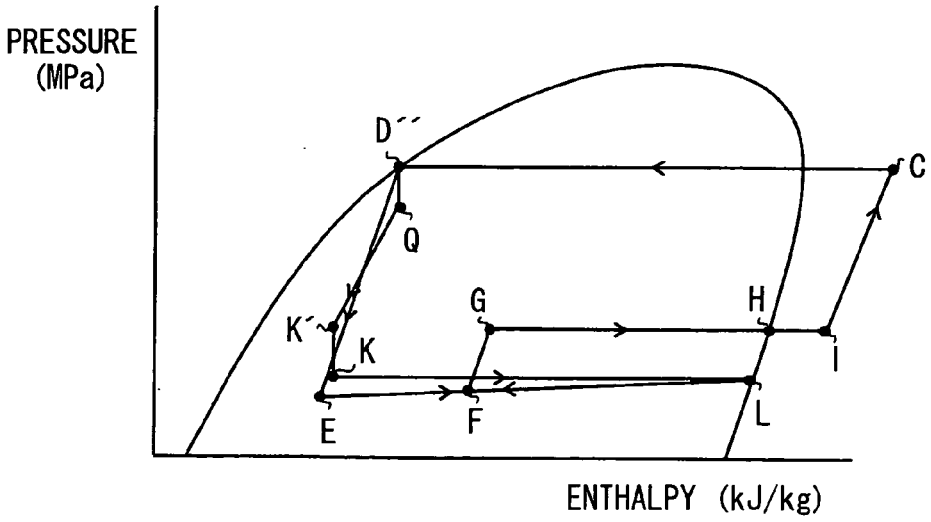
FIG. 16 is a Mollier diagram showing operation of the ejector refrigerant cycle device according to the eighth embodiment.

In the eighth embodiment, as shown in FIG. 15, the vapor/liquid separating unit 30 which has the same structure as that of the fifth embodiment is added to the refrigerant cycle of the fourth embodiment, and the branch portion A is provided in the liquid-phase refrigerant reservoir of the vapor/liquid separating unit 30. Other components of this embodiment have the same structures as those of the fourth embodiment. The operation state of the refrigerant in the cycle of the eighth embodiment is shown in a Mollier diagram of FIG. 16. In FIG. 16, the same reference numerals are used to represent the same state of the refrigerant as that shown in FIG. 8.

When the refrigerant cycle of the embodiment is operated, the refrigerant at the branch portion A is refrigerant on a saturated liquid line (as indicated by the point D" of FIG. 14). In the eighth embodiment, even if the refrigerant at the outlet of the radiator 12 becomes either the super-cooled state or the vapor-liquid two-phase state, the first fixed throttle 19*a* of the inner heat exchanger 19 can decompress the refrigerant appropriately. Thus, even when the refrigerant branched at the branch portion A becomes the refrigerant on the saturated liquid line, the same effect as that of the above-described fourth embodiment can be obtained.

Furthermore, similarly to the fifth embodiment, the refrigerant can be decompressed appropriately and constantly by the fixed throttle 19*a* of the inner heat exchanger 19 without being affected by the operating state of the refrigerant cycle of the ejector refrigerant cycle device.

Ninth Embodiment

Figure 17:
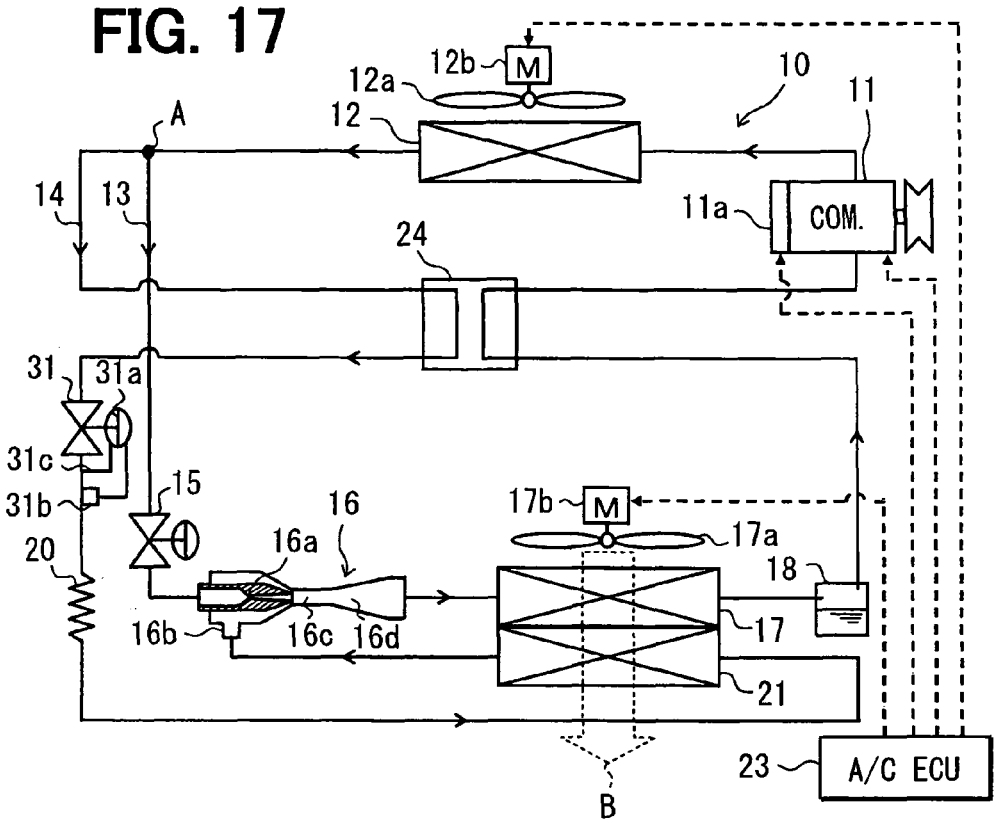
FIG. 17 is a schematic diagram showing an ejector refrigerant cycle device according to a ninth embodiment of the present invention.

In the above-described second embodiment, the first fixed throttle 25 is located upstream of the second fixed throttle 20 in a refrigerant flow of the suction-port side piping 14 branched from the branch portion A. In the ninth embodiment, as shown in FIG. 17, a variable throttle mechanism 31 is used instead of the first fixed throttle 25 of the second embodiment. This variable throttle mechanism 31 is configured to reduce a refrigerant passage area as the degree of super-cooling of the refrigerant on the downstream side of the radiator 12 increases.

For example, the variable throttle mechanism 31 is a mechanical variable throttle mechanism, and adjusts the degree of an opening of a valve body (not shown) in accordance with the temperature and pressure of the refrigerant at the outlet of the variable throttle mechanism 31, thereby adjusting the flow amount of the refrigerant passing through the variable throttle mechanism 31. Accordingly, the refrigerant state at the outlet of the variable throttle mechanism 31 can be surely adjusted to a predetermined vapor-liquid two-phase state.

More specifically, the valve body of the variable throttle mechanism 31 is connected to a diaphragm member 31*a* serving as pressure response means. Furthermore, the diaphragm member 31 a displaces the valve body in accordance with the pressure of filled gas media of the temperature sensitive cylinder 31*b* (e.g., pressure according to the temperature of the refrigerant at the outlet of the variable throttle mechanism 31) and the pressure level of the refrigerant at the outlet of the variable throttle mechanism 31 which is introduced into an equalizing pipe 31*c*, thereby adjusting the opening degree of the valve body. Other components of this embodiment except for the variable throttle mechanism 31 may have the same structures as those of the second embodiment.

Therefore, the state of the refrigerant in the operation of the refrigerant cycle of this embodiment shows substantially the same Mollier diagram as that of the second embodiment shown in FIG. 4. Furthermore, in the embodiment, the refrigerant flowing into the second fixed throttle 20 can be surely brought into the vapor-liquid two-phase state by the variable throttle mechanism 31, thereby surely obtaining the same effect as that of the second embodiment.

Tenth Embodiment

Figure 18:
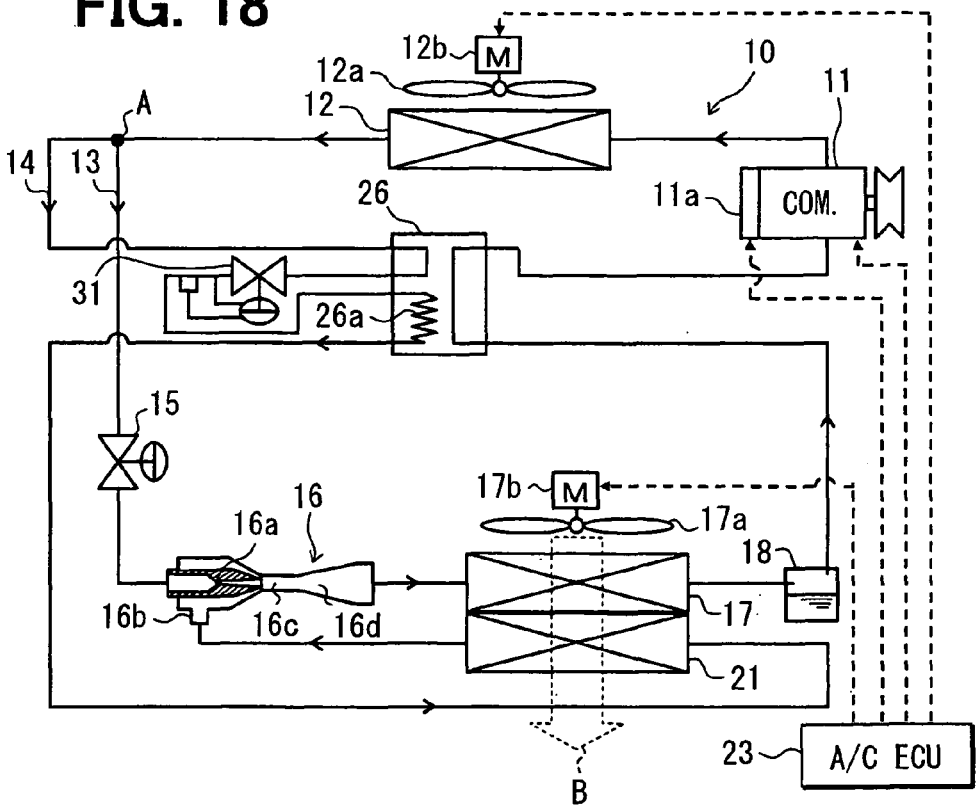
FIG. 18 is a schematic diagram showing an ejector refrigerant cycle device according to a tenth embodiment of the present invention.

In the above-described third embodiment, the second fixed throttle 26*b* is located upstream of the first fixed throttle 26*a* provided in the inner heat exchanger 26. However, in the tenth embodiment, as shown in FIG. 18, instead of the second fixed throttle 26 of the third embodiment, the variable throttle mechanism 31 which is the same as that of the ninth embodiment is used. In the refrigerant cycle of the tenth embodiment shown in FIG. 18, the other parts are similar to those of the above-described third embodiment.

Therefore, the state of the refrigerant in the operation of the cycle of the tenth embodiment shows substantially the same Mollier diagram as that of the third embodiment shown in FIG. 6. Furthermore, in the tenth embodiment, the refrigerant flowing into the first fixed throttle 26*a* that is downstream of the variable throttle mechanism 31 can be surely brought into the vapor-liquid two-phase state by the variable throttle mechanism 31, thereby surely obtaining the same effect as that of the third embodiment.

Eleventh Embodiment

Figure 19:
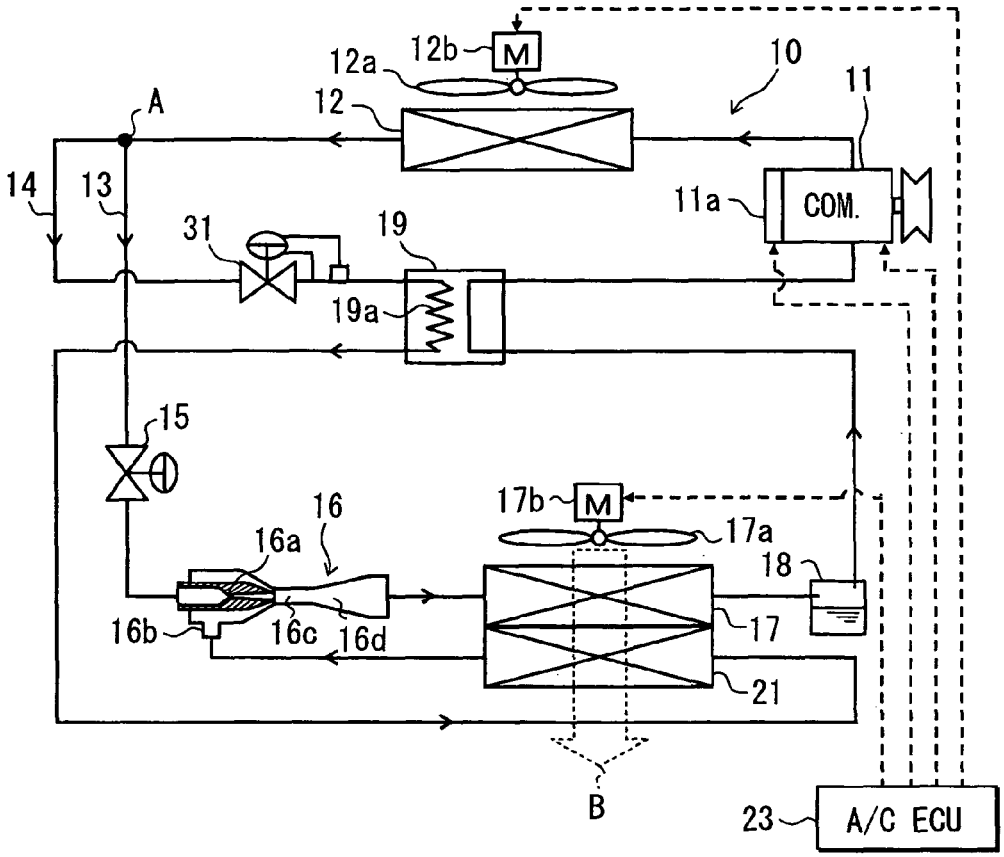
FIG. 19 is a schematic diagram showing an ejector refrigerant cycle device according to an eleventh embodiment of the present invention.
Figure 24:
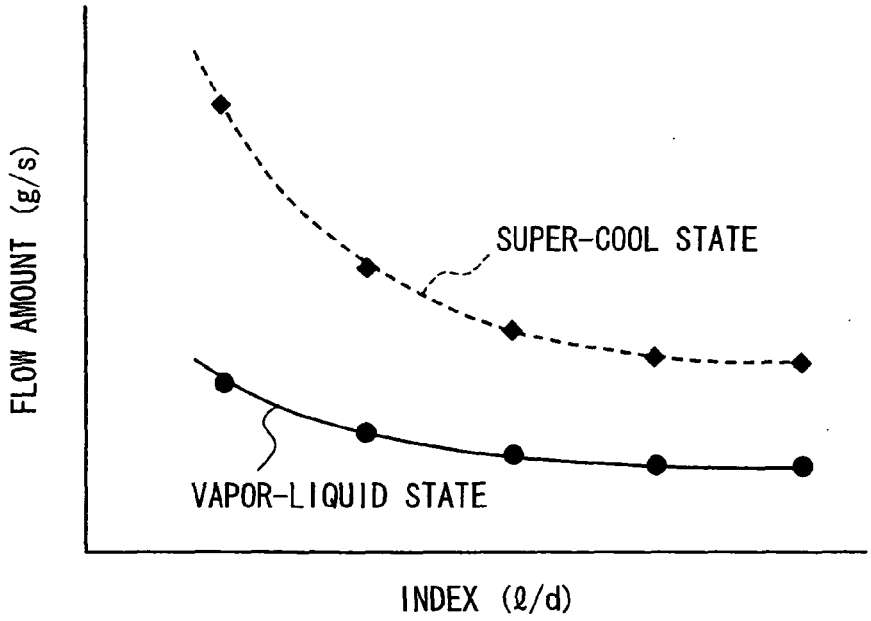
FIG. 24 is a graph showing the relationship between a shape of a throttle mechanism and a flow amount of refrigerant passing through the throttle mechanism.

In the above-described fourth embodiment, the second fixed throttle 27 is located upstream of the first fixed throttle 19*a* provided in the inner heat exchanger 19. However, in the eleventh embodiment, as shown in FIG. 19, instead of the second fixed throttle 27 of the fourth embodiment, the variable throttle mechanism 31 which is the same as that of the above-described ninth embodiment is used. In the refrigerant cycle of the eleventh embodiment shown in FIG. 19, the other parts may be similar to those of the above-described fourth embodiment.

Therefore, the state of the refrigerant in the operation of the cycle of this embodiment shows substantially the same Mollier diagram as that of the fourth embodiment shown in FIG. 8. Furthermore, in the eleventh embodiment, the refrigerant flowing into the first fixed throttle 19*a* can be surely brought into the vapor-liquid two-phase state by the variable throttle mechanism 31, thereby surely obtaining the same effect as that of the fourth embodiment.

Twelfth Embodiment

Figure 20:
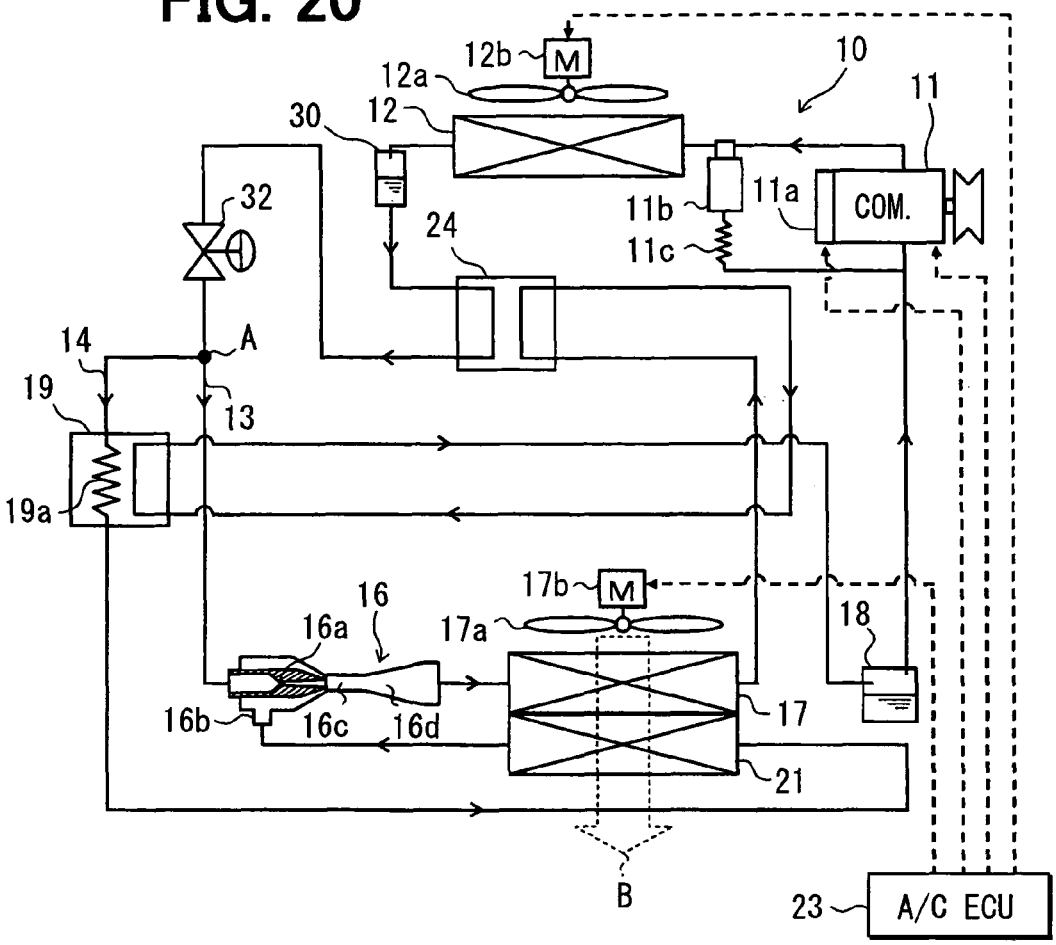
FIG. 20 is a schematic diagram showing an ejector refrigerant cycle device according to a twelfth embodiment of the present invention.

In the twelfth embodiment, as shown in FIG. 20, an oil separator 11*b* for separating lubricating oil from the refrigerant is provided on the discharge side of the compressor 11 with respect to the structure of the refrigerant cycle of the first embodiment. The oil separator 11*b* is arranged so as to separate the lubricating oil for lubricating the compressor 11 dissolved in the refrigerant from the refrigerant and to return the oil to the refrigerant suction side of the compressor 11 via a decompression mechanism 11*c*.

Furthermore, in the embodiment, a vapor/liquid separating unit 30 is disposed on a downstream side of the radiator 12. The vapor/liquid separating unit 30 has the same basic structure as that of the vapor/liquid separating unit which is used in each of the fifth to eighth embodiments. It should be noted that a liquid-phase refrigerant reservoir of the vapor/liquid separating unit 30 of this embodiment is connected only to a first inner heat exchanger 24. Thus, the branch portion A is not provided in the liquid-phase refrigerant reservoir of the vapor/liquid separating unit 30 of the twelfth embodiment.

The first inner heat exchanger 24 of this embodiment has the same structure as the inner heat exchanger 24 of the second embodiment, and has only a function of exchanging heat between the liquid-phase refrigerant on the downstream side of the vapor/liquid separating unit 30 and the refrigerant on the suction side of the compressor 11 (more specifically, the refrigerant passing through a refrigerant passage from the outlet side of the first evaporator 17 to the suction port of the compressor 11). Moreover, an outlet for the liquid-phase refrigerant on the high-pressure side of the first inner heat exchanger 24 is connected to a variable throttle mechanism 32.

The variable throttle mechanism 32 is for decompressing and expanding the liquid-phase refrigerant in the super-cooled state to bring it into the vapor-liquid two-phase state, and can employ a mechanical or electrical expansion valve. On the downstream side of the variable throttle mechanism 32 is disposed the branch portion A for branching the refrigerant flow.

The refrigerant streams branched by the branch portion A are adapted to flow into the nozzle-portion side piping 13 and into the suction-port side piping 14 similarly to the first embodiment. A second inner heat exchanger 19 is disposed on the downstream side of the branch portion A in the suction-port side piping 14, and on the upstream side of the second evaporator 21.

Therefore, in this embodiment, the fixed throttle 19*a* of the second inner heat exchanger 19 (specifically, a capillary tube) constitutes the decompression means for decompressing and expanding the refrigerant branched by the branch portion A.

Also, the variable throttle mechanism 32 is disposed on the downstream side of the radiator 12 and on the upstream side of the branch portion A, and constitutes the decompression means for decompressing and expanding the refrigerant flowing into the branch portion A. That is, the variable throttle mechanism 32 decompresses the refrigerant to flow into the fixed throttle 19*a* of the second inner heat exchanger 19 in the ejector refrigerant cycle device.

Furthermore, the second inner heat exchanger 19 constitutes refrigerant radiating means for radiating heat of the refrigerant in the decompression and expansion process with the fixed throttle 19*a*.

Moreover, in the twelfth embodiment, the compressor-suction side refrigerant on the suction side of the compressor 11 (i.e., refrigerant passing through a refrigerant passage from the outlet side of the first evaporator 17 to the suction port of the compressor 11), as shown in FIG. 20, flows from the first evaporator 17 to exchange heat with the liquid-phase refrigerant on the downstream side of the vapor/liquid separating unit 30 at the first inner heat exchanger 24. Furthermore, the compressor-suction side refrigerant flowing out of the first inner heat exchanger 24 exchanges heat with the refrigerant on the downstream side of the branch portion A, at the second inner heat exchanger 19. Thereafter, the compressor-suction side refrigerant flows into the accumulator 18 to be separated into the vapor phase and the liquid phase, and the gas-phase refrigerant is drawn in the compressor 11.

It is apparent that the refrigerant passage of the refrigerant to be drawn into the compressor 11 is not limited to the structure consisting of elements arranged in the above-mentioned order of FIG. 20, and may have any structure of elements arranged in any other order. For example, the refrigerant to be drawn into the compressor 11 may flow from the first evaporator 17 to exchange heat with the refrigerant on the downstream side of the branch portion A at the second inner heat exchanger 19 in first, and then may exchange heat with the liquid-phase refrigerant on the downstream side of the vapor/liquid separating unit 30 at the first inner heat exchanger 24. Thereafter, the refrigerant may flow into the accumulator 18. Other components of the twelfth embodiment may have the same structures as those of the first embodiment.

Figure 21:
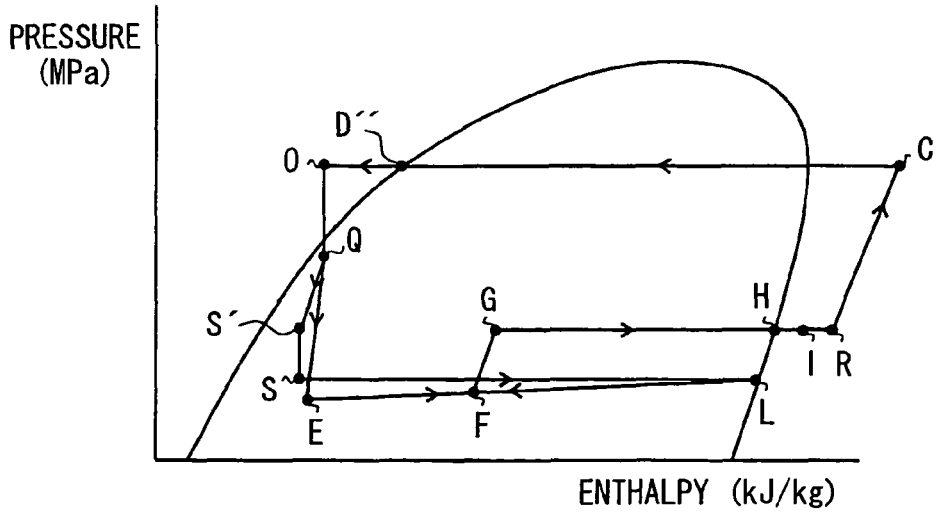
FIG. 21 is a Mollier diagram showing operation of the ejector refrigerant cycle device according to the twelfth embodiment.

Next, an operation of the refrigerant cycle of the twelfth embodiment and the operation state of the refrigerant in the cycle will be described below with reference to a Mollier diagram of FIG. 21. In FIG. 21, the same reference numerals are used to represent the same operation state of the refrigerant as that described in the above-mentioned embodiments.

First, when the refrigerant cycle of the embodiment is operated, the refrigerant discharged from the compressor 11 (as indicated by the point C of FIG. 21) is cooled by the radiator 12, and is separated by the vapor/liquid separating unit 30 into the vapor-phase refrigerant and the liquid-phase refrigerant. Thus, the liquid-phase refrigerant at the vapor/liquid separating unit 30 is saturated liquid refrigerant on a saturated liquid line as indicated by the point D" of FIG. 21.

The liquid-phase refrigerant flowing from the vapor/liquid separating unit 30 flows into the first inner heat exchanger 24 to exchange heat with the refrigerant on the suction side of the compressor 11 to radiate the heat, so that the refrigerant is brought into the super-cooled state (from the point D" to the point O of FIG. 21). Furthermore, the liquid-phase refrigerant in the super-cooled state flowing from the first inner heat exchanger 24 is decompressed by the variable throttle mechanism 32 to become the vapor-liquid two-phase state (from the point O to the point Q of FIG. 21).

The vapor-liquid two-phase refrigerant decompressed by the variable throttle mechanism 32 is divided into two flows by the branch portion A, one of which flows to the nozzle-portion side piping 13, and then from the nozzle portion 16*a* to the mixing portion 16*c*, the diffuser portion 16*d* of the ejector 16, and the first evaporator 17 in that order (from the point Q to the point E, the point F, the point G, and the point H of FIG. 21 in that order).

The refrigerant flowing out of the first evaporator 17 first flows into the first inner heat exchanger 24 to exchange heat with the liquid-phase refrigerant flowing from the vapor/liquid separating unit 30 (from the point H to the point I of FIG. 21). Then, the refrigerant to be drawn to the compressor 11 flows into the second inner heat exchanger 19 to exchange heat with the high-pressure refrigerant flowing from the branch portion A to the suction-port side piping 14, to flow into the accumulator 18 (from the point I to the point R of FIG. 21). And, the vapor-phase refrigerant from the accumulator 18 is drawn into and compressed again by the compressor 11 (from the point R to the point C of FIG. 21).

On the other hand, the refrigerant in the vapor-liquid two-phase state flowing from the branch portion A to the suction-port side piping 14 flows into the second inner heat exchanger 19. And the refrigerant flowing into the second inner heat exchanger 19 is decompressed and expanded when passing through the fixed throttle 19*a* of the second inner heat exchanger 19, while exchanging heat with the refrigerant on the suction side of the compressor 11 to radiate the heat (from the point Q to the point S' and the point S in that order of FIG. 21).

Here, since the refrigerant in the vapor-liquid two-phase state flows into the fixed throttle 19*a*, the refrigerant can be decompressed appropriately by the fixed throttle 19*a*. Note that even in the line from the point S' to the point S of FIG. 21, for the same reason as the third embodiment, the refrigerant passing through the fixed throttle 19*a* is expanded substantially in an isentropic manner.

Similarly to the above-described first embodiment, the refrigerant flowing to the second evaporator 21 absorbs heat from the blown air of the blower fan 17*a*, which has been cooled by the first evaporator 17, to evaporate, and the evaporated refrigerant in the second evaporator 21 is drawn into the refrigerant suction port 16*b* of the ejector 16, so that the drawn refrigerant is mixed with the refrigerant having passed through the nozzle portion 16*a* in the mixing portion 16*c* (from the point S to the point L and the point F of FIG. 21).

As mentioned above, in the embodiment, the variable throttle mechanism 32 allows the refrigerant in the vapor-liquid two-phase state on the downstream side to flow into the fixed throttle 19*a*, thereby appropriately decompressing the refrigerant at the fixed throttle 19*a*. The refrigerant evaporation temperatures of the first evaporator 17 and the second evaporator 21 can surely be set in the different temperature ranges, and the second evaporator 21 can exert the sufficient refrigeration capacity.

Furthermore, in the fixed throttle 19*a*, because the refrigerant on the downstream side of the branch portion A is decompressed and expanded while simultaneously radiating heat as shown by lines from the point Q to the point S of the Mollier diagram of FIG. 21, the pressure of the refrigerant can be decreased, and at the same time the enthalpy of the refrigerant can be decreased. This can increase the difference in enthalpy of the refrigerant between the refrigerant inlet and outlet of the second evaporator 21 (refrigeration capacity), resulting in improvement of the cycle efficiency.

Moreover, since the refrigerant cycle is provided with the variable throttle mechanism 32 for decompressing and expanding the refrigerant on the upstream side of the branch portion A in a refrigerant flow from the radiator 12, the operation state of the refrigerant flowing into the branch portion A is easily made stable. Therefore, according to the present embodiment, the refrigerant flowing into the branch portion A is stabilized to the vapor-liquid two-phase state, which can appropriately decompress the refrigerant by the fixed throttle 19*a* without being affected by the operating state of the refrigerant cycle in the ejector refrigerant cycle device.

Thirteenth Embodiment

Figure 22:
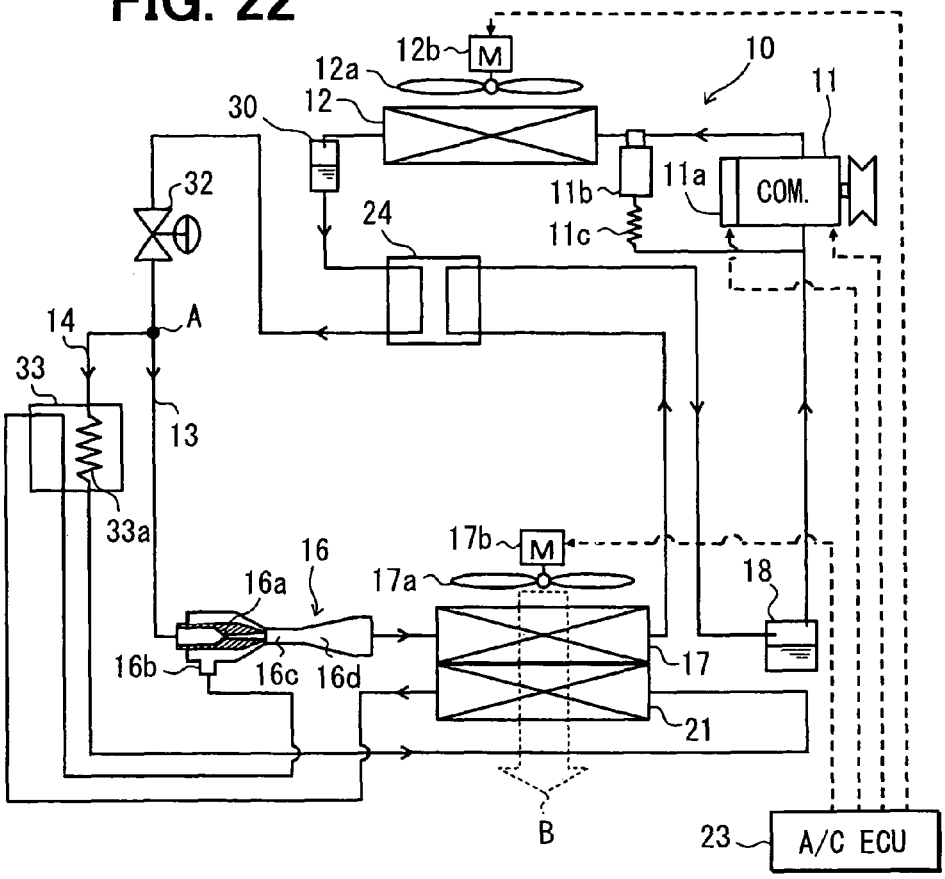
FIG. 22 is a schematic diagram showing an ejector refrigerant cycle device according to a thirteenth embodiment of the present invention.

In the above-described twelfth embodiment, the second inner heat exchanger 19 is used, which exchanges heat between the refrigerant on the downstream side of the branch portion A and the refrigerant on the suction side of the compressor 11. In this embodiment, as shown in FIG. 22, a second inner heat exchanger 33 is used, which exchanges heat between the refrigerant before flowing into the second evaporator 21 on the downstream side of the branch portion A and the refrigerant on the downstream side of the second evaporator 21.

The second inner heat exchanger 33 has a structure similar to the basic structure of the second inner heat exchanger 19 of the twelfth embodiment. Thus, a refrigerant passage of the second inner heat exchanger 33 on the downstream side of the branch portion A is formed of a fixed throttle 33*a* (specifically, a capillary tube), while the second inner heat exchanger 33 constitutes the refrigerant radiating means in the ejector refrigerant cycle device.

Furthermore, the second inner heat exchanger 33 is to exchange heat between the refrigerant on the downstream side of the branch portion A before flowing into the second evaporator 21 and the refrigerant on the downstream side of the second evaporator 21 after passing through the second evaporator 21. Thus, in the embodiment, as shown in FIG. 22, the refrigerant flowing out of the first evaporator 17 exchanges heat with the liquid-phase refrigerant on the downstream side of the vapor/liquid separating unit 30 at the first inner heat exchanger 24, and then flows into the accumulator 18 to be separated into the vapor phase and the liquid phase to be drawn into the compressor 11, which constitutes the refrigerant passage. Other components of the thirteenth embodiment have the same structures as those of the twelfth embodiment.

Figure 23:
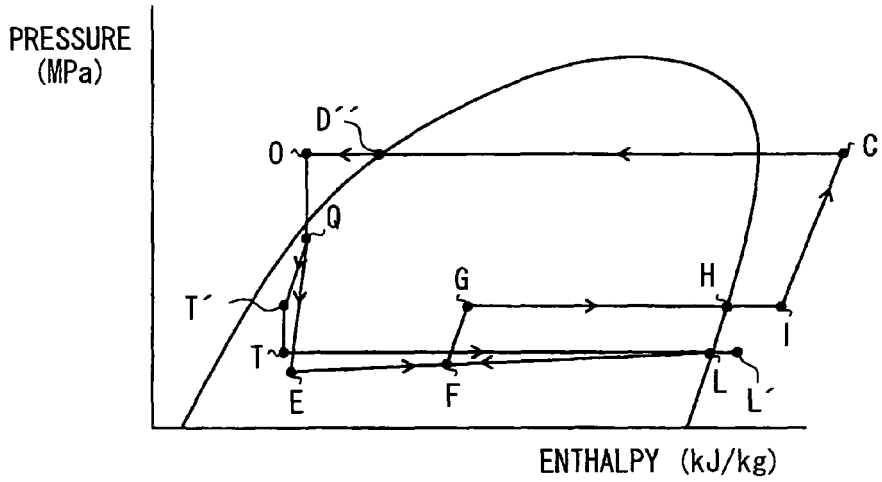
FIG. 23 is a Mollier diagram showing operation of the ejector refrigerant cycle device according to the thirteenth embodiment.

Next, an operation of the refrigerant cycle of the thirteenth embodiment and the operation state of the refrigerant in the cycle will be described below with reference to a Mollier diagram of FIG. 23. In FIG. 23, the same reference numerals are used to represent substantially the same state of the refrigerant as that shown in the above-mentioned embodiments.

First, similarly to the twelfth embodiment, when the refrigerant cycle of the thirteenth embodiment is operated, the refrigerant discharged from the compressor 11 is cooled by the radiator 12, and flows to the vapor/liquid separating unit 30, a first refrigerant passage of the first inner heat exchanger 24, and the variable throttle mechanism 32 in that order to be brought into the vapor-liquid two-phase state (from the point C to the point D", the point O, and the point Q of FIG. 23 in that order).

The vapor-liquid two-phase refrigerant decompressed by the variable throttle mechanism 32 is divided by the branch portion A into two flows, one of which flows to the nozzle-portion side piping 13 and then from the nozzle portion 16*a*, the mixing portion 16*c*, the diffuser portion 16*d* of the ejector 16, and the first evaporator 17 in that order (from the point Q, to the point E, the point F, the point G, the point H of FIG. 21 in that order).

The refrigerant flowing out of the first evaporator 17 flows into a second refrigerant passage of the first inner heat exchanger 24 and exchanges heat with the liquid-phase refrigerant flowing from the vapor/liquid separating unit 30 so as to be introduced into the accumulator 18 (from the point H to the point I of FIG. 23). And, the vapor-phase refrigerant is drawn from the accumulator 18 into and again compressed by the compressor 11 (from the point I to the point C of FIG. 23).

On the other hand, the refrigerant in the vapor-liquid two-phase state flowing from the branch portion A to the suction-port side piping 14 flows to the second inner heat exchanger 33. The refrigerant flowing into the second heat exchanger 33 from the branch portion A is decompressed and expanded, while simultaneously exchanging heat with the refrigerant on the downstream side of the second evaporator 21 when passing through the fixed throttle 33*a* of the second inner heat exchanger 33 to radiate the heat (from the point Q to the point T' and the point T of FIG. 23 in that order). At this time, the refrigerant on the downstream side of the second evaporator 21 has its enthalpy increased (from the point L to the point L' of FIG. 23).

Here, the refrigerant in the vapor-liquid two-phase state flows into the fixed throttle 33*a* from the branch portion A, the fixed throttle 33*a* can decompress the refrigerant appropriately before flowing into the second evaporator 21. Note that as indicated by a line from the point T' to the point T of FIG. 23, the refrigerant having passed the fixed throttle 33*a* expands substantially in an isentropic manner for the same reason as the above-described third embodiment.

Furthermore, likewise the twelfth embodiment, the refrigerant flowing into the second evaporator 21 is drawn into the refrigerant suction port 16*b* of the ejector 16 and is mixed with the liquid-phase refrigerant having passed through the nozzle portion 16*a* in the mixing portion 16*c* (from the point T to the point L' and the point F of FIG. 21 in that order). In addition, in the thirteenth embodiment, the refrigerant flowing out of the second evaporator 21 is drawn into the suction port 16*b* of the ejector 16 after passing through the second inner heat exchanger 33 and being heat exchanged with the vapor-liquid two-phase refrigerant flowing through the fixed throttle 33*a* of the second inner heat exchanger 21. Therefore, the enthalpy of refrigerant at the outlet side of the second evaporator 21 can be reduced thereby increasing the enthalpy difference between the refrigerant outlet side and the refrigerant inlet side of the second evaporator 21.

As mentioned above, in the thirteenth embodiment, the variable throttle mechanism 32 decompresses the refrigerant to be in the vapor-liquid two-phase state, and the decompressed refrigerant of the variable throttle mechanism 32 is introduced into the fixed throttle 33*a* after being branched by the branch portion A. Therefore, the refrigerant on the downstream side of the branch portion A is decompressed and expanded by the fixed throttle 33*a* of the second inner heat exchanger 33, while radiating heat in the second inner heat exchanger 33, thereby obtaining the same effect as that of the twelfth embodiment.

Other Embodiments

The present invention is not limited to the embodiments described above, and various modifications can be made to the embodiments as follows.

(1) In each embodiment except for the above-mentioned second, sixth, and ninth embodiments, the capillary tube 19*a*, 26*a*, 33*a* is used as the fixed throttle, and the capillary tube 19*a*, 26*a*, 33*a* are brazed to a refrigerant piping (i.e., heat-exchanging refrigerant piping to be heat exchanged with the capillary tube 19*a*, 26*a*, 33*a*) in the inner heat exchanger, thereby constituting refrigerant radiating means for radiating heat of the refrigerant in the decompression and expansion process in the inner heat exchanger. Specifically, the connection of the capillary tube 19*a*, 26*a*, 33*a* with the heat-exchanging refrigerant piping in the inner heat exchanger may be carried out in the following way.

For example, each of the capillary tube 19*a*, 26*a*, 33*a* may be disposed linearly on the outer peripheral surface of the heat-exchanging refrigerant piping along the axial direction of the heat-exchanging refrigerant piping in the inner heat exchanger, and the capillary tube 19*a*, 26*a*, 33*a* and the heat-exchanging refrigerant piping may be integrally connected by a metal bonding material having excellent thermal conductivity in the inner heat exchanger. As the metal bonding material, soldering or brazing filler metal can be used. Furthermore, the capillary tube 19*a*, 26*a*, 33*a* may be arranged to be wound around the outer peripheral surface of the heat exchanging refrigerant piping in a spiral manner in each inner heat exchanger.

The whole area of each of the capillary tube 19*a*, 26*a*, 33*a* does not need to be connected to the heat-exchanging refrigerant piping in the inner heat exchanger, and a part of each of the capillary tube 19*a*, 26*a*, 33*a* may be connected to the heat-exchanging refrigerant piping in the inner heat exchanger. In other words, while the area of each capillary tube 19*a*, 26*a*, 33*a* which is not connected to the heat exchanging refrigerant piping of the inner heat exchanger may serve only to decompress and expand the refrigerant, the area of each capillary tube 18*a*, 26*a*, 33*a* which is connected to the heat-exchanging refrigerant piping of the inner heat exchanger may serve to radiate the heat of the refrigerant in the decompression and expansion process.

Furthermore, as shown in the entire configuration diagram of the above-mentioned embodiments, as the inner heat exchanger, a counterflow type heat exchanging structure is used in which the flow direction of the refrigerant passing through the capillary tube 19*a*, 26*a*, 33*a* is opposed to the flow direction of the refrigerant passing through the heat-exchanging refrigerant piping on the suction side of the compressor 11, thereby improving a heat exchange efficiency.

(2) In each embodiment except for the above-mentioned second, sixth, and ninth embodiments, the inner heat exchanger 19, 26, and 33 is used as the refrigerant radiating means, but the refrigerant radiating means is not limited thereto.

For example, a blower fan for blowing cooling air toward the fixed throttle (capillary tubes) 19*a*, 26*a*, 33*a* of the inner heat exchanger 19, 26, 33 may be provided so that the air blown by the blower fan exchanges heat with the refrigerant passing through the fixed throttle 19*a*, 26*a*, 33*a*, thereby radiating the heat of the refrigerant passing through the fixed throttle 19*a*, 26*a*, 33*a*.

(3) In the above-mentioned sixth to eighth embodiments, the vapor/liquid separating unit 30 is provided. However, the variable throttle mechanism 31 may be used in the refrigerant cycle of the sixth to eighth embodiments, similarly to the ninth to eleventh embodiments.

With this, the saturated liquid refrigerant on the saturated liquid line flows into the variable throttle mechanism 31, which can improve the controllability of the refrigerant when decompressing the refrigerant into the vapor-liquid two-phase state. This surely makes it easier to allow the refrigerant in the vapor-liquid two-phase state, before flowing into the next decompressing means.

(4) In the above-mentioned ninth to eleventh embodiments, the variable throttle mechanism 31 constructed with the mechanical variable throttle mechanism is used, and the opening degree of the valve is adjusted by detecting the temperature and pressure of the refrigerant at the outlet of the variable throttle mechanism 31. However, the temperature and pressure of the refrigerant at the outlet of the radiator 21 may be detected so as to adjust the opening degree of the valve in the variable throttle mechanism 31. Alternatively, as the variable throttle mechanism 31, an electric variable throttle mechanism may be used. Even in this case, the (5) Although in the above-mentioned twelfth and thirteenth embodiments, the oil separator 11*b* for separating the lubricating oil from the refrigerant is provided on the suction side of the compressor 11 as one example, it is apparent that the oil separator 11*b* and the decompression mechanism 11*c* may be applied to the refrigerant cycle of each of the first to eleventh embodiments.

(6) In the above-mentioned embodiments, the variable throttle mechanism 15 is disposed on the upstream side of the nozzle portion 16*a* of the ejector 16, and the flow amount ratio η(η=Ge/Gnoz) of the refrigerant flow amount Ge into the suction side piping 14 to the refrigerant flow amount Gnoz into the nozzle-portion side piping 13 from the branch portion A is adjusted. However, a variable flow amount type ejector may be used in which the variable throttle mechanism 15 is withdrawn and the area of the refrigerant passage of the nozzle portion 16*a* can be altered electrically and/or mechanically.

In this case, for example, with the structure of the first embodiment, the degree of superheat of the refrigerant at the outlet of the second evaporator 21 may be detected, and an opening degree of the refrigerant passage area of the nozzle portion 16*a* may be controlled such that the superheat degree of the refrigerant at the outlet of the second evaporator 21 is within a predetermined range.

(7) In the above-mentioned embodiments, the first evaporator 17 and the second evaporator 21 are located to cool the same space. However, a space to be cooled by the first evaporator 17 may be different from a space to be cooled by the second evaporator 21. For example, the first evaporator 17 may be used for air-conditioning inside the vehicle compartment, and the second evaporator 21 may be used for a refrigerator provided in the vehicle compartment. Also, the present invention may be applied to a refrigerant cycle which exerts the cooling action only by the second evaporator 21 and which withdraws the first evaporator 17 therefrom. That is, the first evaporator 17 described in the above embodiments may be omitted in each refrigerant cycle of the ejector refrigerant cycle device. Furthermore, the accumulator 18 described in the above embodiments may be omitted in each refrigerant cycle of the ejector refrigerant cycle device.

(8) In the above-mentioned embodiments, the first evaporator 17 and the second evaporator 21 serve as an indoor heat exchanger for cooling the space to be cooled, and the radiator 12 serves as an outdoor heat exchanger for radiating heat into the air. Conversely, the present invention may be applied to a heat pump cycle in which the first evaporator 17 and the second evaporator 21 serve as the outdoor heat exchanger for absorbing heat from a heat source, such as outside air, and the radiator 12 serves as the indoor heat exchanger for heating a fluid to be heated, such as air or water to be supplied.

Such changes and modifications are to be understood as being within the scope of the present invention as defined by the appended claims.

What is claimed is:

1. An ejector refrigerant cycle device comprising:

a compressor compressing and discharging refrigerant;

a radiator radiating heat of high-temperature and high-pressure refrigerant discharged from the compressor;

a branch portion branching a flow of refrigerant on a downstream side of the radiator into a first stream and a second stream;

an ejector located on a downstream side of the branch portion, the ejector including a nozzle portion decompressing and expanding refrigerant of the first stream, and a refrigerant suction port from which refrigerant is drawn from the second stream by a high-velocity flow of refrigerant jetted from the nozzle portion;

a first decompressing portion decompressing refrigerant of the second stream branched from the branch portion;

a first evaporator evaporating refrigerant on a downstream side of the first decompressing portion, the first evaporator being disposed in the second stream and having a refrigerant outlet coupled to the refrigerant suction port of the ejector;

a second decompressing portion decompressing refrigerant of the second stream in a vapor-liquid two-phase state, the second decompressing portion being located downstream of the branch portion and upstream of the first decompressing portion in a refrigerant flow of the second stream; and an inner heat exchanger having a first refrigerant passage portion through which refrigerant of the second stream flows, and a second refrigerant passage portion through which refrigerant to be drawn to the compressor flows, wherein the first refrigerant passage portion and the second refrigerant passage portion of the inner heat exchanger are configured to perform heat exchange between refrigerant flowing through the first refrigerant passage portion and refrigerant flowing through the second refrigerant passage portion, wherein the first decompressing portion is provided in the first refrigerant passage portion of the inner heat exchanger, integrally with the inner heat exchanger; and the first decompressing portion causing the refrigerant to radiate heat simultaneously with the decompression of the refrigerant of the second stream branched from the branch portion.

2. The ejector refrigerant cycle device according to claim 1, wherein the first decompressing portion includes a capillary tube.

3. The ejector refrigerant cycle device according to claim 1, wherein the first decompressing portion is a capillary tube provided in the first refrigerant passage portion of the inner heat exchanger.

4. The ejector refrigerant cycle device according to claim 1, wherein the second decompressing portion is a variable throttle mechanism, the variable throttle mechanism reducing a throttle passage area of the variable throttle mechanism as a temperature of refrigerant at a downstream side of the radiator decreases.

5. The ejector refrigerant cycle device according to claim 1, further comprising a vapor/liquid separating unit separating refrigerant on a downstream side of the radiator into vapor-phase refrigerant and liquid-phase refrigerant, wherein the branch portion branches the liquid-phase refrigerant separated by the vapor/liquid separating unit into the first stream and the second stream.

6. The ejector refrigerant cycle device according to claim 1, wherein the refrigerant flowing through the second refrigerant passage portion flows to the compressor.

7. The ejector refrigerant cycle device according to claim 1, further comprising a second evaporator on a downstream side of the ejector, the refrigerant flowing through the nozzle flowing directly to the second evaporator.

8. The ejector refrigerant cycle device according to claim 1, wherein only the refrigerant from the first stream of the branch portion flows into the nozzle portion of the ejector.

9. The ejector refrigerant cycle device according to claim 1, wherein the first decompressing portion is bonded to the second refrigerant passage portion of the inner heat exchanger, and the second refrigerant passage portion is connected to a refrigerant suction side of the compressor.

10. The ejector refrigerant cycle device according to claim 1, wherein the inner heat exchanger includes double-piping having an inner piping and an outer piping, the inner piping is a capillary tube used as the first decompressing portion, and the outer piping and the inner piping define therebetween a space used as the second refrigerant passage portion of the inner heat exchanger.

* * * * *